US009988844B2

(12) United States Patent
Russell et al.

(10) Patent No.: US 9,988,844 B2
(45) Date of Patent: Jun. 5, 2018

(54) RAM ACCELERATOR SYSTEM WITH RAIL TUBE

(71) Applicant: HYPERSCIENCES, INC., Spokane, WA (US)

(72) Inventors: Mark C. Russell, Spokane, WA (US); Timothy John Elder, Seattle, WA (US)

(73) Assignee: HYPERSCIENCES, INC., Spokane, WA (US)

( * ) Notice: Subject to any disclaimer, the term of this patent is extended or adjusted under 35 U.S.C. 154(b) by 227 days.

(21) Appl. No.: 14/919,657

(22) Filed: Oct. 21, 2015

(65) Prior Publication Data

US 2016/0123081 A1 May 5, 2016

Related U.S. Application Data

(60) Provisional application No. 62/067,923, filed on Oct. 23, 2014.

(51) Int. Cl.
*E21B 7/00* (2006.01)
*E21B 7/16* (2006.01)

(52) U.S. Cl.
CPC ..... *E21B 7/007* (2013.01); *E21B 7/16* (2013.01)

(58) Field of Classification Search
CPC ..... E21B 7/007; E21B 7/16
See application file for complete search history.

(56) References Cited

U.S. PATENT DOCUMENTS 2,544,573 A 3/1951 Vincent
2,621,732 A 12/1952 Ahlgren
2,913,959 A 11/1959 Mohaupt
3,075,463 A 1/1963 Eilers et al.
3,185,224 A 5/1965 Robinson, Jr.
3,244,232 A 4/1966 Myers
3,253,511 A * 5/1966 Zwicky ..... F41A 1/08 244/63
3,441,095 A 4/1969 Youmans
3,695,715 A 10/1972 Godfrey
3,863,723 A 2/1975 Godfrey
3,867,867 A 2/1975 Duff
4,030,557 A 6/1977 Alvis et al.
4,063,486 A 12/1977 Ashley
4,123,975 A 11/1978 Mohaupt (Continued)

FOREIGN PATENT DOCUMENTS

DE 2420035 3/1976
WO 1999037878 7/1999

OTHER PUBLICATIONS

Semick, Joshua T., "Notice of Allowance dated May 25, 2016", U.S. Appl. No. 14/708,932, The United States Patent and Trademark Office, dated May 25, 2016.

(Continued)

*Primary Examiner* — James G Sayre
(74) *Attorney, Agent, or Firm* — Lindauer Law, PLLC

(57) ABSTRACT

A ram accelerator device may utilize rails arranged within a guide tube that may be emplaced downhole. The rails may serve to direct a hypervelocity projectile along the length of the guide tube. The rails may carry utilities or provide other services to operate the system. For example, electrical wiring for power, control signaling, and so forth, may be placed within the rails. In another example, gasses may be delivered by the rails.

20 Claims, 22 Drawing Sheets

(56) References Cited

U.S. PATENT DOCUMENTS

| | | | | |
|---|---|---|---|---|
| 4,467,878 | A | 8/1984 | Ibsen | |
| 4,582,147 | A | 4/1986 | Dardick | |
| 4,638,712 | A | 1/1987 | Chawla et al. | |
| 4,679,637 | A | 7/1987 | Cherrington et al. | |
| 4,722,261 | A | 2/1988 | Titus | |
| 4,791,850 | A | 12/1988 | Minovitch | |
| 4,932,306 | A * | 6/1990 | Rom | F41A 1/04 102/436 |
| 4,982,647 | A * | 1/1991 | Hertzberg | F41A 1/04 102/523 |
| 5,063,826 | A | 11/1991 | Bulman | |
| 5,097,743 | A * | 3/1992 | Hertzberg | F41A 1/02 60/767 |
| 5,098,163 | A | 3/1992 | Young, III | |
| 5,421,237 | A * | 6/1995 | Naumann | F41A 21/46 244/63 |
| 5,487,405 | A | 1/1996 | Skoglund | |
| 5,574,244 | A | 11/1996 | Powell et al. | |
| 5,578,783 | A * | 11/1996 | Brandeis | F41A 1/00 102/490 |
| 5,768,940 | A | 6/1998 | Kawaguchi et al. | |
| 5,833,003 | A | 11/1998 | Longbottom et al. | |
| 5,996,709 | A | 12/1999 | Norris | |
| 6,000,479 | A | 12/1999 | Ambs | |
| 6,035,784 | A | 3/2000 | Watson | |
| 6,457,417 | B1 | 10/2002 | Beal | |
| 6,467,387 | B1 | 10/2002 | Espinosa et al. | |
| 6,591,731 | B2 | 7/2003 | Goldstein | |
| 7,069,862 | B2 | 7/2006 | Bassett | |
| 7,681,352 | B2 | 3/2010 | Fu et al. | |
| 7,942,481 | B2 | 5/2011 | Leppanen | |
| 8,181,561 | B2 | 5/2012 | Riggs et al. | |
| 8,302,584 | B1 * | 11/2012 | Lu | F41B 6/003 124/3 |
| 8,943,970 | B2 | 2/2015 | Greeley et al. | |
| 9,169,695 | B1 | 10/2015 | Calvert | |
| 2005/0034896 | A1 | 2/2005 | Youan | |
| 2007/0044963 | A1 | 3/2007 | MacDougall | |
| 2008/0205191 | A1 | 8/2008 | Coste et al. | |
| 2010/0032206 | A1 * | 2/2010 | Becker | E21B 7/007 175/4.5 |
| 2011/0114388 | A1 | 5/2011 | Lee et al. | |
| 2014/0260930 | A1 | 9/2014 | Russell | |

OTHER PUBLICATIONS

Committee on Advance Drilling Technologies, "Drilling and Excavation Technologies for the Future," National Research Council, ISBN: 0-309-57320-3, 176 pages. (1994). Retrieved from Internet: <http://www.nap.edu/catalog/2349.html>.

Copenheaver, Blaine R., "Patent Cooperation Treaty International Search Report and Written Opinion dated Aug. 10, 2015", Patent Cooperation Treaty Application No. PCT/US2015/030320, Patent Cooperation Treaty, dated Aug. 10, 2015.

Gold, et al., "Concrete Penetration by Eroding Projectiles: Experiments and Analysis," Journal of Engineering Mechanics, vol. 122, No. 2, Feb. 1996, pp. 145-152. [retrieved on Feb. 17, 2013]. Downloaded from Internet: <ascelibrary.org>.

Gold, et al., "Constitutive Models for Concrete Penetration Analysis", Journal of Engineering Mechanics, vol. 122, No. 3, Mar. 1996, pp. 230-238. [retrieved on Feb. 17, 2013]. Downloaded from Internet: <ascelibrary.org>.

Lundquist, Robert G., "Underground Tests of the Ream Method of Rock Fragmentation for High-Speed Tunneling", Rapid Excavation and Tunneling Conference Proceedings, vol. 1. Chapter 56. Jan. 1974, pp. 825-840. [retrieved on Mar. 13, 2013]. Retrieved from Internet: <http://www.onemine.org/view/?d=689528D8459E7257609C73381053FBF203FD5CC5A9FC7839952A414670F0591638551>.

Weber, Jonathan C., "Non-Final Office Action dated Jun. 1, 2015", U.S. Appl. No. 13/841,236, The United States Patent and Trademark Office, dated Jun. 1, 2015.

Fang, et al., "Hypersonic wave drag reduction performance of cylinders with repetitive laser energy depositions," 3rd International Photonics & OptoElectronics Meetings (POEM 2010), Journal of Physics: Conference Series 276 (2011) 012021, [retrieved on Oct. 20, 2015]. Retrieved from Internet: <http://iopscience.iop.org/article/10.1088/1742-6596/276/1/012021/pdf> 8 pages.

Young, Lee W., "Patent Cooperation Treaty International Search Report and Written Opinion dated May 16, 2014", Patent Cooperation Treaty Application No. PCT/US14/12317, Patent Cooperation Treaty, dated May 16, 2014.

Weber, Jonathan C., "Notice of Allowance dated Jul. 14, 2016", U.S. Appl. No. 13/841,236, The United States Patent and Trademark Office, dated Jul. 14, 2016.

Young, Lee W., "Patent Cooperation Treaty International Search Report and Written Opinion dated May 16, 2014", Patent Cooperation Treaty Application No. PCT/US2014/012317, Patent Cooperation Treaty, dated May 16, 2014.

Young, Lee W.,"Patent Cooperation Treaty International Search Report and Written Opinion dated Jan. 8, 2016", Patent Cooperation Treaty Application No. PCT/US2015/056947, Patent Cooperation Treaty, dated Jan. 8, 2016.

Semick, Joshua T., "Non-final Office Action dated Jul. 18, 2017", U.S. Appl. No. 15/246,414, The United States Patent and Trademark Office, dated Jul. 18, 2017.

Kasten, Klaus, "European Search Report dated Jan. 23, 2017", European Application No. 14770528.9, European Patent Office, dated Jan. 23, 2017.

Young, Lee W., "Patent Cooperation Treaty International Search Report and Written Opinion dated Jan. 19, 2017", Patent Cooperation Treaty Application No. PCT/US16/60129, Patent Cooperation Treaty, dated Jan. 19, 2017.

Wittmann-Regis, Agnes, "International Preliminary Report on Patentability dated May 4, 2017", Patent Cooperation Treaty Application No. PCT/US2015/056947, Patent Cooperation Treaty, dated May 4, 2017.

Becamel, Philippe, "Patent Cooperation Treaty International Preliminary Report on Patentability dated Sep. 15, 2015", Patent Cooperation Treaty Application PCT/US2014/012317, dated Sep. 15, 2015.

Weber, Johnathan C., "Non-final Office Action dated Dec. 20, 2016", U.S. Appl. No. 15/292,011, The United States Patent and Trademark Office, dated Dec. 20, 2016.

Weber, Jonathan C.,"Final Office Action dated Jun. 15, 2017", U.S. Appl. No. 15/292,011, The United States Patent and Trademark Office, dated Jun. 15, 2017.

* cited by examiner

RAM ACCELERATOR SYSTEM WITH RAIL TUBE

PRIORITY

This application claims priority to U.S. Patent Provisional Application Ser. No. 62/067,923 filed on Oct. 23, 2014, entitled "Ram Accelerator System with Rail Tube." The entirety of this previously filed provisional application is hereby incorporated by reference.

BACKGROUND

Traditional drilling and excavation methods utilize drills to form holes in one or more layers of material to be penetrated. Excavation, quarrying, and tunnel boring may also use explosives placed in the holes and detonated in order to break apart at least a portion of the material. The use of explosives may result in additional safety and regulatory burdens which increase operational cost. Typically these methods cycle through drill, blast, removal of material, ground support and other stages, and are relatively slow (many minutes to hours to days per linear foot is typical depending on the cross-sectional area being moved) methods for removing material to form a desired excavation.

BRIEF DESCRIPTION OF DRAWINGS

Certain implementations and embodiments will now be described more fully below with reference to the accompanying figures, in which various aspects are shown. However, various aspects may be implemented in many different forms and should not be construed as limited to the implementations set forth herein. The figures are not necessarily to scale, and the relative proportions of the indicated objects may have been modified for ease of illustration and not by way of limitation. Like numbers refer to like elements throughout.

DETAILED DESCRIPTION

Figure 1:
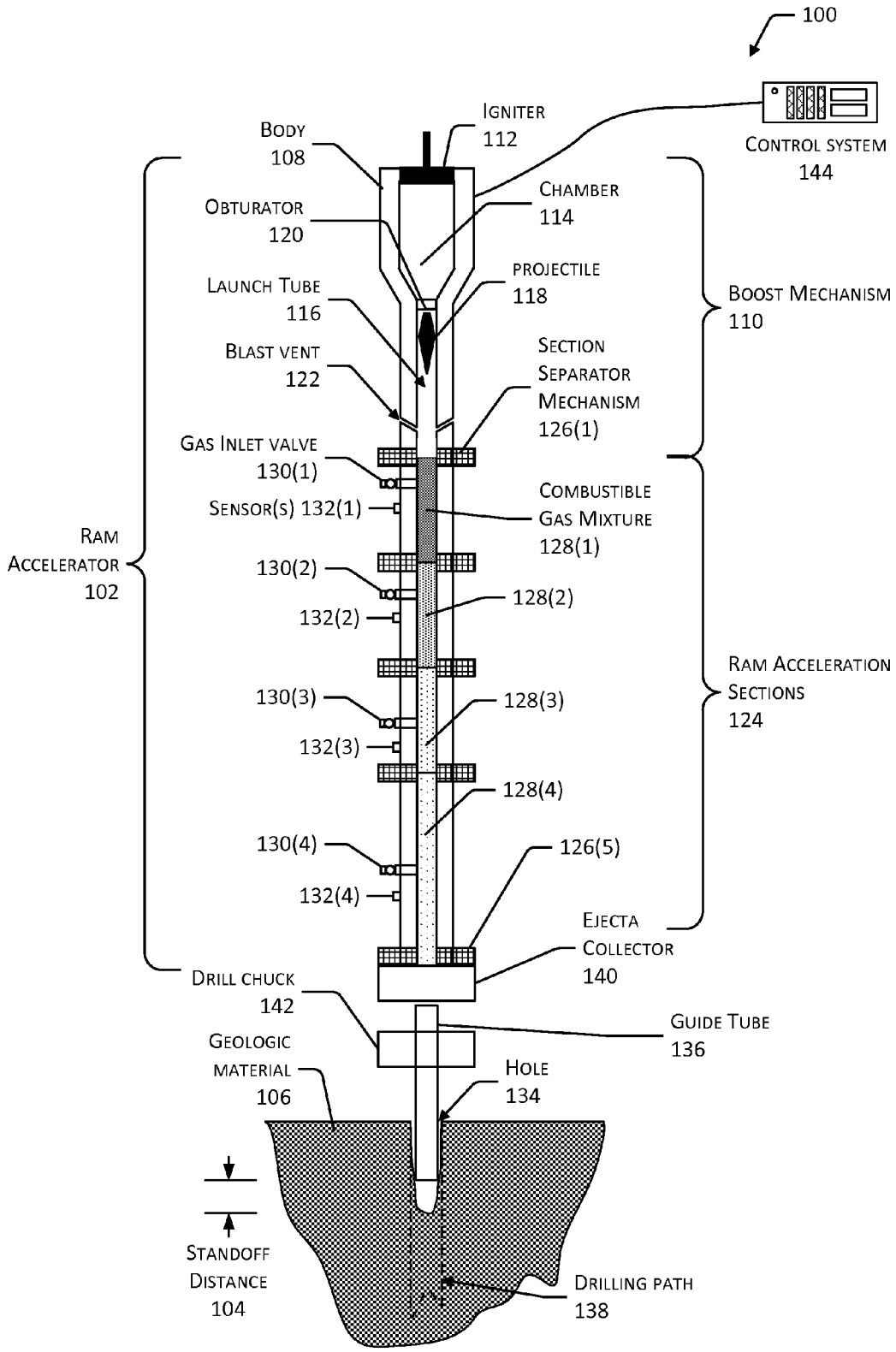
FIG. 1 is an illustrative system for drilling or excavating using a ram accelerator comprising a plurality of sections holding one or more combustible gasses configured to propel a projectile towards a working face of material.

Conventional drilling and excavation techniques used for penetrating materials typically rely on mechanical bits used to cut or grind at a working face. These materials may include metals, ceramics, geologic materials, and so forth. Tool wear and breakage on the mechanical bits slows these operations, increasing costs. Furthermore, the rate of progress of cutting through material such as hard rock may be prohibitive. Drilling may be used in the establishment of water wells, geothermal wells, oil wells, gas wells, underground pipelines, and so forth. Additionally, the environmental impact of conventional techniques may be significant. For example, conventional drilling may require a significant supply of water which may not be readily available in arid regions. As a result, resource extraction may be prohibitively expensive, time consuming, or both.

Described in this disclosure are systems and techniques for using a ram accelerator to fire one or more projectiles toward the working face of the geologic material. The ram accelerator includes a launch tube separated into multiple sections. Each of the sections is configured to hold one or more combustible gases. A projectile is boosted to a ram velocity down the launch tube and through the multiple sections. At the ram velocity, a ram compression effect provided at least in part by a shape of the projectile initiates combustion of the one or more combustible gasses in a ram combustion effect, accelerating the projectile. In some implementations, the projectile may accelerate to a hypervelocity. In some implementations, hypervelocity includes velocities greater than or equal to two kilometers per second upon ejection or exit from the ram accelerator launch tube. In other implementations, the projectile may accelerate to a non-hypervelocity. In some implementations, non-hypervelocity includes velocities below two kilometers per second.

The projectiles ejected from the ram accelerator strike a working face of the geologic material. Projectiles travelling at hypervelocity typically interact with the geologic material at the working face as a fluid-fluid interaction upon impact, due to the substantial kinetic energy in the projectile. This interaction may also be described as hydroelastic or hydroplastic. This interaction forms a hole which is generally in the form of a cylinder. By firing a series of projectiles, a hole may be drilled through the geologic material. In comparison, projectiles travelling at non-hypervelocity interact with the geologic material at the working face as a solid-solid interaction. This interaction may fracture or fragment the geologic material, and may form a hole which is cylindrical or a crater having a conical profile.

A section separator mechanism is configured to provide one or more barriers between the different sections in the ram accelerator which contain the one or more combustible gasses. Each section may be configured to contain one or more combustible gasses in various conditions such as particular pressures, and so forth. The section separator mechanism may employ a diaphragm, valve, and so forth which is configured to seal one or more sections. During firing, the projectile passes through the diaphragm, breaking the seal, or the valve is opened prior to launch. A reel mechanism may be used to move an unused section of the diaphragm into place, restoring the seal. Other separator mechanisms such as ball valves, plates, endcaps, gravity gradient, and so forth may also be used. The separator mechanisms may be configured to operate as blow out preventers, anti-kick devices, and so forth. For example, the separator mechanisms may comprise ball valves configured to close when pressure from down the hole exceeds a threshold pressure.

The hole formed by the impact of the projectiles may be further guided or processed. A guide tube (also known as a "drift tube") may be inserted into the hole to prevent subsidence, direct a drilling path, deploy instrumentation, and so forth. In one implementation, a reamer or slip-spacer may be coupled to the guide tube and inserted downhole. The reamer may comprise one or more cutting or grinding surfaces configured to shape the hole into a substantially uniform cross section. For example, the reamer may be configured to smooth the sides of the hole.

The reamer may also be configured to apply lateral force between the guide tube and the walls of the hole, canting or otherwise directing the drill in a particular direction. This directionality enables the ram accelerator to form a curved drilling path.

The guide tube is configured to accept the projectiles ejected from the ram accelerator and direct them towards the working face. A series of projectiles may be fired from the ram accelerator down the guide tube, allowing for continuous drilling operations. Other operations may also be provided, such as inserting a continuous concrete liner into the hole.

Ejecta comprising materials resulting from the impact of the one or more projectiles with the geologic material may be removed from the hole. In some implementations, a back pressure resulting from the impact may force the ejecta from the hole. In some implementations a working fluid such as compressed air, water, and so forth may be injected into the hole to aid in removal of at least a portion of the ejecta. The injection may be done continuously, prior to, during, or after, each launch of the projectile.

One or more ram accelerators may also be deployed to drill several holes for tunnel boring, excavation, and so forth. A plurality of accelerators may be fired sequentially or simultaneously to strike one or more target points on a working face. After several holes are formed from projectile impacts, various techniques may be used to remove pieces of geologic material defined by two or more holes which are proximate to one another. Mechanical force may be applied by breaker arms to snap, break, or otherwise free pieces of the geologic material from a main body of the geologic material at the working face. In other implementations, conventional explosives may be placed into the ram accelerator drilled holes and detonated to shatter the geologic material.

In some implementations, conventional drilling techniques and equipment may be used in conjunction with ram accelerator drilling. For example, ram accelerator drilling may be used to reach a particular target depth. Once at the target depth, a conventional coring drill may be used to retrieve core samples from strata at the target depth.

The systems and techniques described may be used to reduce the time, costs, and environmental impacts involved in resource extraction, resource exploration, construction, and so forth. Furthermore, the capabilities of ram accelerator drilling enable deeper exploration and recovery of natural resources. Additionally, the energy released during impact may be used for geotechnical investigation such as reflection seismology, strata characterization, and so forth.

Illustrative Systems and Mechanisms

FIG. 1 is an illustrative system 100 for drilling or excavating using a ram accelerator 102. A ram accelerator 102 may be positioned at a standoff distance 104 from geologic material 106 or target material. The geologic material 106 may comprise rock, dirt, ice, and so forth. The ram accelerator 102 has a body 108. The body 108 may comprise one or more materials such as steel, carbon fiber, ceramics, and so forth.

The ram accelerator 102 includes a boost mechanism 110. The boost mechanism 110 may include one or more of a gas gun, electromagnetic launcher, solid explosive charge, combustible gas, liquid explosive charge, backpressure system, and so forth. The boost mechanism 110 may operate by providing a relative differential in speed between a projectile 118 and particles in the one or more combustible gasses which is equal to or greater than a ram velocity. The ram velocity is the velocity of the projectile 118, relative to particles in the one or more combustible gasses, at which the ram effect occurs. In some implementations, at least a portion of the launch tube 116 within the boost mechanism 110 may be maintained at a vacuum prior to launch.

In the example depicted here, the boost mechanism comprises a detonation gas gun, including an igniter 112 coupled to a chamber 114. The chamber 114 may be configured to contain one or more combustible or explosive or detonable materials which, when triggered by the igniter 112, generate an energetic reaction. For example, the chamber 114 may be filled with hydrogen and oxygen. In the gas gun implementation depicted, the chamber 114 is coupled to a launch tube 116 within which the projectile 118 is placed. In some implementations, the projectile 118 may include or be adjacent to an obturator 120 configured to seal, at least temporarily, the chamber 114 from the launch tube 116. The obturator 120 may be attached to the projectile 118, integrated but frangible from the projectile 118, separate from but in-contact with the projectile 118, and so forth. One or more blast vents 122 may be provided to provide release of the reaction byproducts. In other implementations, no blast vents 122 may be present. In some implementations the launch tube 116 may be smooth, rifled, include one or more guide rails or other guide features, and so forth. The launch tube 116, or portions thereof, may be maintained at a pressure which is lower than that of the ambient atmosphere.

For example, portions of the launch tube 116 such as those in the boost mechanism 110 may be evacuated to a pressure of less than 25 torr.

The boost mechanism 110 is configured to initiate a ram effect with the projectile 118. The ram effect results in compression of one or more combustible gasses by the projectile 118 and subsequent combustion proximate to a back side of the projectile 118. This compression results in heating of the one or more combustible gasses, triggering ignition. The ignited gasses combusting in an exothermic reaction, impart an impulse on the projectile 118 which is accelerated down the launch tube 116. In some implementations, ignition may be assisted or initiated using a pyrotechnic igniter. The pyrotechnic igniter may either be affixed to or a portion of the projectile 118, or may be arranged within the launch tube 116.

The boost mechanism 110 may use an electromagnetic, solid explosive charge, liquid explosive charge, gas explosive charge, stored compressed gasses, and so forth to propel the projectile 118 along the launch tube 116 at the ram velocity. In some implementations, a backpressure system may be used. The backpressure system accelerates at least a portion of the one or more combustible gasses past a stationary projectile 118, producing the ram effect in an initially stationary projectile 118. For example, the combustible gas mixture under high pressure may be exhausted from ports within the launch tube 116 past the projectile 118 as it rests within the launch tube 116. This relative velocity difference achieves the ram velocity, and the ram effect of combustion begins and pushes the projectile 118 down the launch tube 116. Hybrid systems may also be used, in which the projectile 118 is moved and backpressure is applied simultaneously. In another implementation, a diaphragm may be moved towards the projectile 118, displacing the combustible gasses past the stationary projectile 118 to produce the ram effect.

The projectile 118 passes along the launch tube 116 from the boost mechanism 110 into one or more ram acceleration sections 124. The ram acceleration sections 124 (or "sections") may be bounded by section separator mechanisms 126. The section separator mechanisms 126 are configured to maintain a combustible gas mixture 128 which has been admitted into the section 124 via one or more gas inlet valves 130 in the particular section 124. Each of the different sections 124 may have a different combustible gas mixture 128.

Different sections 124 may be separated by various members, such as cups, panels, or diaphragms that prevent mixing of different combustible gas mixtures that are at or near the same pressure on either side.

The section separator mechanisms 126 may include valves such as ball valves, diaphragms, gravity gradient, liquids, endcaps, or other structures or materials configured to maintain the different combustible gas mixtures 128 substantially within their respective sections 124. In one implementation described below with regard to FIG. 3, the diaphragm may be deployed using a reel mechanism, allowing for relatively rapid reset of the diaphragms following their penetration by the projectile 118 during operation of the ram accelerator 102. In other implementations, the launch tube 116 may be arranged at an angle which is not perpendicular to local vertical, such that gravity holds the different combustible gas mixtures 128 at different heights, based on their relative densities. For example, lighter combustible gas mixtures 128 "float" on top of heavier combustible gas mixtures 128 which sink or remain on the bottom of the launch tube 116. In another example, fluid at the bottom of the hole 134 may provide a seal which allows the guide tube 136 to be filled with a combustible gas mixture 128 and used as a ram acceleration section 124.

In this illustration four sections 124(1)-(4) are depicted, as maintained by five section separator mechanisms 126(1)-(5). When primed for operation, each of the sections 124(1)-(4) are filled with the combustible gas mixtures 128(1)-(4). In other implementations, different numbers of sections 124, section separator mechanisms 126, and so forth may be used.

The combustible gas mixture 128 may include one or more combustible gasses. The one or more combustible gasses may include an oxidizer or an oxidizing agent. For example, the combustible gas mixture 128 may include hydrogen and oxygen gas in a ratio of 2:1. Other combustible gas mixtures may be used, such as silane and carbon dioxide. The combustible gas mixture 128 may be provided by extraction from ambient atmosphere, electrolysis of a material such as water, from a solid or liquid gas generator using solid materials which react chemically to release a combustible gas, from a previously stored gas or liquid, and so forth.

The combustible gas mixtures 128 may be the same or may differ between the sections 124. These differences include chemical composition, pressure, temperature, and so forth. For example, the density of the combustible gas mixture 128 in each of the sections 124(1)-(4) may decrease along the launch tube 116, such that the section 124(1) holds the combustible gas 128 at a higher pressure than the section 124(4). In another example, the combustible gas mixture 128(1) in the section 124(1) may comprise oxygen and propane while the combustible gas mixture 128(3) may comprise oxygen and hydrogen.

One or more sensors 132 may be configured at one or more positions along the ram accelerator 102. These sensors 132 may include pressure sensors, chemical sensors, density sensors, fatigue sensors, strain gauges, accelerometers, proximity sensors, and so forth.

The ram accelerator 102 is configured to eject the projectile 118 from an ejection end of the launch tube 116 and towards a working face of the geologic material 106 or other material. Upon impact, a hole 134 may be formed. The ejection end is the portion of the ram accelerator 102 which is proximate to the hole 134.

A series of projectiles 118 may be fired, one after another, to form a hole which grows in length with each impact. The ram accelerator 102 may accelerate the projectile 118 to a hypervelocity. As used in this disclosure, hypervelocity includes velocities greater than or equal to two kilometers per second upon ejection or exit from the ram accelerator launch tube.

In other implementations, the projectile 118 may accelerate to a non-hypervelocity. Non-hypervelocity includes velocities below two kilometers per second. Hypervelocity and non-hypervelocity may also be characterized based on interaction of the projectile 118 with the geologic material 106 or other material. For example, hypervelocity impacts are characterized by a fluid-fluid type interaction, while non-hypervelocity impacts are typically described as solid-solid interactions. These interactions are discussed below in more detail with regard to FIGS. 6 and 7.

In some implementations, a guide tube 136 may be inserted into the hole 134. The interior of the guide tube 136 may be smooth, rifled, include one or more guide rails or other guide features, and so forth. The guide tube 136 provides a pathway for projectiles 118 to travel from the ram accelerator 102 to the portion of the geologic materials 106 which are being drilled. The guide tube 136 may also be used to prevent subsidence, direct a drilling path, deploy instrumentation, deploy a reamer, and so forth. The guide tubes 136 may thus follow along a drilling path 138 which is formed by successive impacts of the projectiles 118. The guide tube 136 may comprise a plurality of sections coupled together, such as with threads, clamps, and so forth. The guide tube 136 may be circular, oval, rectangular, triangular, or describe a polyhedron in cross section. The guide tube 136 may comprise one or more tubes or other structures which are nested one within another. For example, the guide tube 136 may include an inner tube and an outer tube which are mounted coaxially, or with the inner tube against one side of the outer tube.

Formation of the hole 134 using the impact of the projectiles 118, result in increased drilling speed compared to conventional drilling by minimizing work stoppages associated with adding more guide tube 136. For example, following repeated firings, the standoff distance 104 may increase to a distance of zero to hundreds of feet. After extending the hole 134 using several projectiles 118, firing may cease while one or more additional guide tube 136 sections are inserted. This insertion may be used to steer or guide the direction of the hole 134. In comparison, conventional drilling may involve stopping every ten feet to add a new section of drill pipe, which results in slower progress. In other implementations, the guide tube 136 may be subsequently advanced as the hole 134 extends.

The direction of the drilling path 138 may be changed by modifying one or more firing parameters of the ram accelerator 102, moving the guide tube 136, and so forth. For example, reamers on the guide tube 136 may exert a lateral pressure by pushing against the walls of the hole 134, bending or tilting the guide tube 136 to a particular direction.

An ejecta collector 140 is configured to collect or capture at least a portion of ejecta which results from the impacts of the one or more projectiles 118. The ejecta collector 140 may be placed proximate to a top of the hole 134, such as coupled to the guide tube 136.

In some implementations, a drill chuck 142 may be mechanically coupled to the guide tube 136, such that the guide tube 136 may be raised, lowered, rotated, tilted, and so forth. Because the geologic material 106 is being removed by the impact of the projectiles 118, the end of the guide tube 136 is not carrying the loads associated with traditional mechanical drilling techniques. As a result, the drill chuck 142 with the ram accelerator system may apply less torque to the guide tube 136, compared to conventional drilling.

The ram accelerator 102 may be used in conjunction with conventional drilling techniques. This is discussed in more detail below with regard to FIG. 2.

In some implementations, an electronic control system 144 may be coupled to the ram accelerator 102, the one or more sensors 132, one or more sensors in the projectiles 118, and so forth. The control system 144 may comprise one or more processors, memory, interfaces, and so forth which are configured to facilitate operation of the ram accelerator 102. The control system 144 may couple to the one or more section separator mechanisms 126, the gas inlet valves 130, and the sensors 132 to coordinate the configuration of the ram accelerator 102 for ejection of the projectile 118. For example, the control system 144 may fill particular combustible gas mixtures 128 into particular sections 124 and recommend a particular projectile 118 type to use to form a particular hole 134 in particular geologic material 106. The control system 144 may also provide for sequencing the opening and closing of the section separator mechanism 126. For example, the control system 144 may send signals or power to the section separator mechanisms 126 enabling them to open to allow for passage of the projectile 118.

In some implementations, instead of or in addition to the section separator mechanism 126, baffles or annular members may be placed within the ram acceleration sections 124. The baffles are configured to allow passage of the projectile 118 during operation. The baffles may allow for a reduction in the number of section separator mechanisms 126 within the ram accelerator 102, guide tube 136, and so forth.

In some implementations, the use of baffles in conjunction with the rail tubes (as described below with regard to FIG. 20) may allow for operation without the use of an obturator 120. By omitting the obturator 120 the mechanisms and the operation of the system 100 may be significantly simplified. For example, the boost mechanism 110 may comprise a detonation gun that uses combustible gasses to fire the projectile 118 without an obturator 120.

Other mechanisms may be present which are not depicted here. For example, an injection system may be configured to add one or more materials into the wake of the projectiles 118. These materials may be used to clean the launch tube 116, clean the guide tube 136, remove debris, and so forth. For example, powdered silica may be injected into the wake of the projectile 118, such that at least a portion of the silica is pulled along by the wake down the launch tube 116, into the hole 134, or both.

While the ram accelerator 102 is depicted above ground, in some implementations the ram accelerator 102 may be at least partially below ground.

Figure 2:
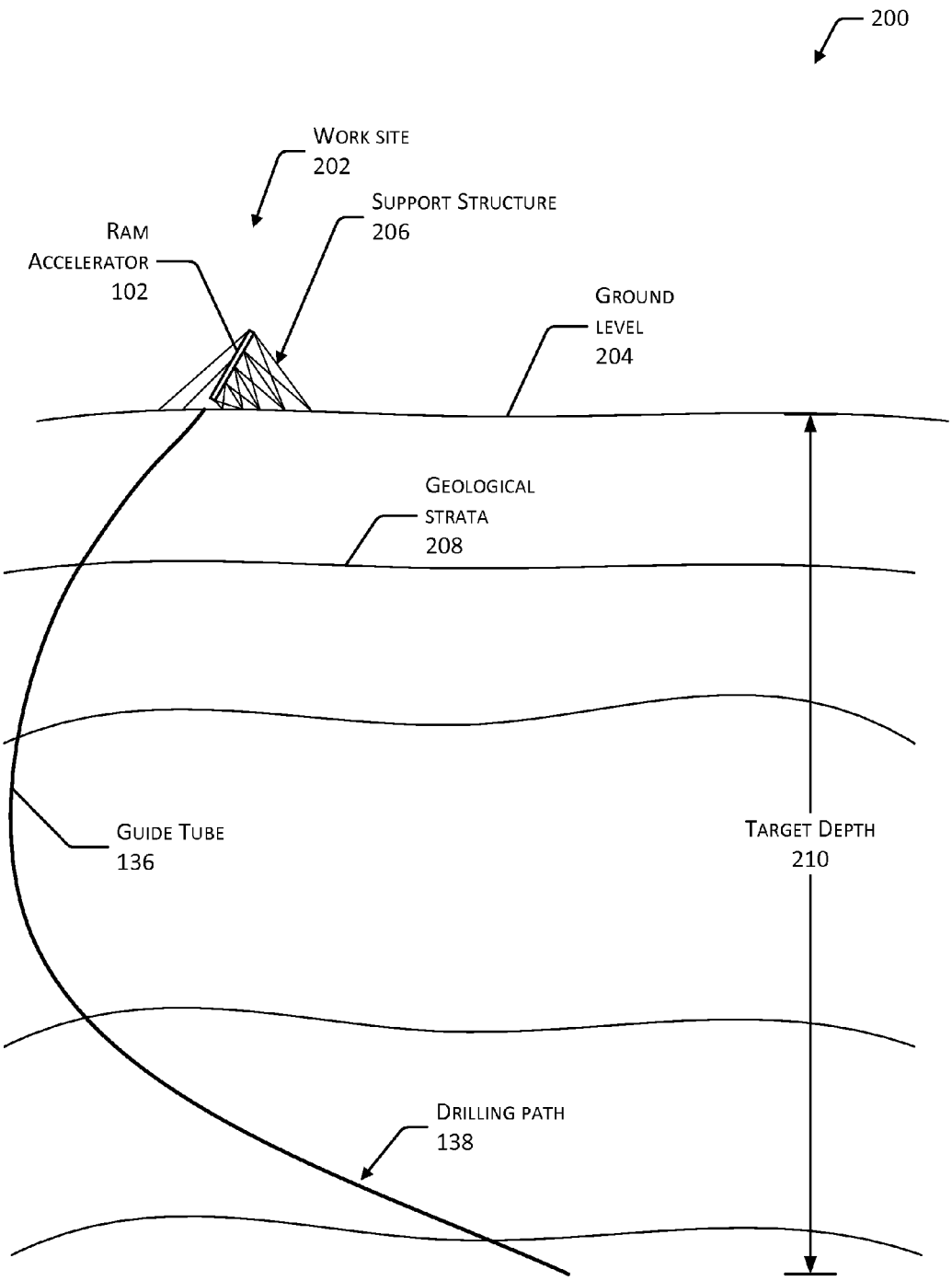
FIG. 2 illustrates a curved drilling path formed using ram accelerator drilling.

FIG. 2 illustrates a scenario 200 in which a curved drilling path 138 formed at least in part by ram accelerator drilling. In this illustration a work site is shown 202 at ground level 204. At the work site 202, a support structure 206 holds the ram accelerator 102. For example, the support structure 206 may comprise a derrick, crane, scaffold, and so forth. In some implementations, the overall length of the ram accelerator 102 may be between 75 to 800 feet. The support structure 206 is configured to maintain the launch tube 116 in a substantially straight line, in a desired orientation during firing. By minimizing deflection of the launch tube 116 during firing of the projectile 118, side loads exerted on the body 108 are reduced. In some implementations, a plurality of ram accelerators 102 may be moved in and out of position in front of the hole 134 to fire their projectiles 118, such that one ram accelerator 102 is firing while another is being loaded.

The ram accelerator 102 may be arranged vertically, at an angle, or horizontally, depending upon the particular task. For example, while drilling a well the ram accelerator 102 may be positioned substantially vertically. In comparison, while boring a tunnel the ram accelerator 102 may be positioned substantially horizontally.

The drilling path 138 may be configured to bend or curve along one or more radii of curvature. The radius of curvature may be determined based at least in part on the side loads imposed on the guide tube 136 during transit of the projectile 118 within.

The ability to curve allows the drilling path 138 to be directed such that particular points in space below ground level 204 may be reached, or to avoid particular regions. For example, the drilling path 138 may be configured to go around a subsurface reservoir. In this illustration, the drilling path 138 passes through several layers of geological strata 208, to a final target depth 210. At the target depth 210, or at other points in the drilling path 138 during impacting, the ejecta from the impacts of the projectiles 118 may be analyzed to determine composition of the various geological strata 208 which the end of the drilling path 138 is passing through.

In some implementations the ram accelerator 102, or a portion thereof, may extend or be placed within the hole 134. For example, the ram accelerator 102 may be lowered down the guide tube 136 and firing may commence at a depth below ground level 204. In this implementation, the ram accelerator 102 may operate without the need for blast vents 122. In another implementation, the guide tube 136, or a portion thereof, may be used as an additional ram acceleration section 124. For example, a lower portion of the guide tube 136 in the hole 134 may be filled with a combustible gas to provide acceleration prior to impact.

Drilling with the ram accelerator 102 may be used in conjunction with conventional drilling techniques. For example, the ram accelerator 102 may be used to rapidly reach a previously designated target depth 210 horizon. At that point, use of the ram accelerator 102 may be discontinued, and conventional drilling techniques may use the hole 134 formed by the projectiles 118 for operations such as cutting core samples and so forth. Once the core sample or other operation has been completed for a desired distance, use of the ram accelerator 102 may resume and additional projectiles 118 may be used to increase the length of the drilling path 138.

In a another implementation, the projectile 118 may be shaped in such a way to capture or measure in-flight the material characteristics of the geologic material 106 or analyze material interaction between material comprising the projectile 118 and the geologic material 106 or other target material. Samples of projectile 118 fragments may be recovered from the hole 134, such as through core drilling and recovery of the projectile 118. Also, sensors in the projectile 118 may transmit information back to the control system 144.

Figure 3:
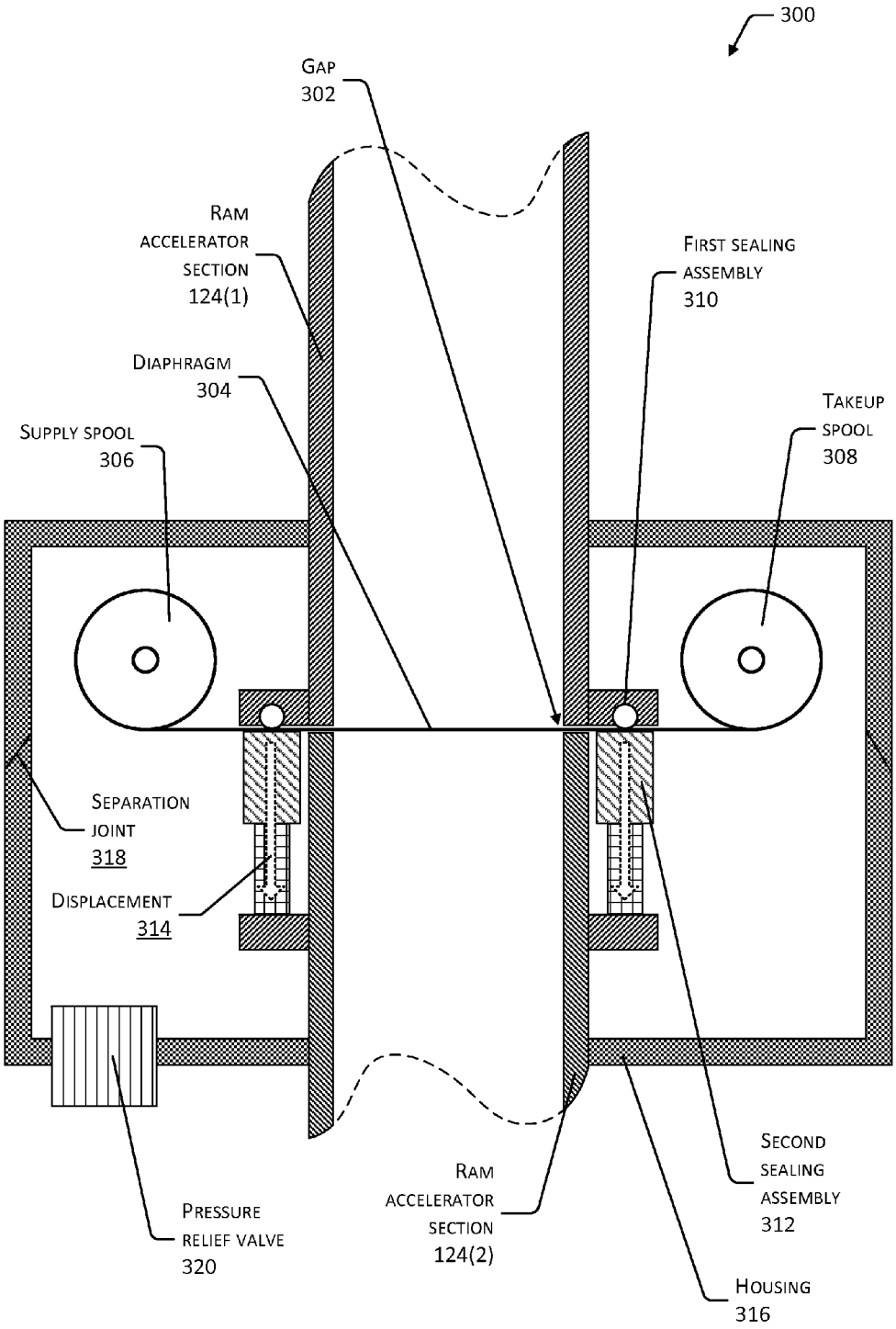
FIG. 3 illustrates a section separator mechanism configured to reset a diaphragm penetrated during launch of the projectile such that a seal is maintained between the sections of the ram accelerator.

FIG. 3 illustrates a mechanism 300 of one implementation of a section separator mechanism 126. As described above, several techniques and mechanisms may be used to maintain the different combustible gas mixtures 128 within particular ram accelerator sections 124.

The mechanism 300 depicted here may be arranged at one or more ends of a particular section 124. For example, the mechanism 300 may be between the sections 124(1) and 124(2) as shown here, at the ejection end of the section 124(4) which contains the combustible gas mixture 128(4), and so forth.

A gap 302 is provided between the ram accelerator sections 124. Through the gap 302, or in front of the launch tube 116 when on the ejection end, a diaphragm 304 extends. The diaphragm 304 is configured to maintain the combustible gas mixture 128 within the respective section 124, prevent ambient atmosphere from entering an evacuated section 124, and so forth.

The diaphragm 304 may comprise one or more materials including, but not limited to, metal, plastic, ceramic, and so forth. For example, the diaphragm 304 may comprise aluminum, steel, copper, nylon, polyvinyl chloride, Mylar, and so forth. In some implementations, a carrier or supporting matrix or structure may be arranged around at least a portion of the diaphragm 304 which is configured to be penetrated by the projectile 118 during firing. The portion of the diaphragm 304 which is configured to be penetrated may differ in one or more ways from the carrier. For example, the carrier may be thicker, have a different composition, and so forth. In some implementations, the portion of the diaphragm 304 which is configured to be penetrated may be scored or otherwise designed to facilitate penetration by the projectile 118.

A supply spool 306 may store a plurality of diaphragms 304 in a carrier strip, or a diaphragm material, with penetrated diaphragms being taken up by a takeup spool 308.

A seal may be maintained between the section 124 and the diaphragm 304 by compressing a portion of the diaphragm 304 or the carrier holding the diaphragm 304 between a first sealing assembly 310 on the first ram accelerator section 124(1) and a corresponding second sealing assembly 312 on the second ram accelerator section 124(2). The second sealing assembly 312 is depicted here as being configured to be displaced as indicated along the arrow 314 toward or away from the first sealing assembly 310, to allow for making or breaking the seal and movement of the diaphragm 304.

During evacuation or filling of the section 124 with the combustible gas mixture 128, the intact diaphragm 304 as sealed between the first sealing assembly 310 and the second sealing assembly 312 seals the section 124. During the firing process, the projectile 118 penetrates the diaphragm 304, leaving a hole. After firing, material may be spooled from the supply spool 306 to the takeup spool 308, such that an intact diaphragm 304 is brought into the launch tube 116 and subsequently sealed by the sealing assemblies.

A housing 316 may be configured to enclose the spools, sealing assembly, and so forth. Various access ports or hatches may be provided which allow for maintenance such as removing or placing the supply spool 306, the takeup spool 308, and so forth. A separation joint 318 may be provided which allows for separation of the first ram accelerator section 124(1) from the second ram accelerator section 124(2). The housing 316, the separation joint 318, and other structures may be configured to maintain alignment of the launch tube 116 during operation. The housing 316 may be configured with one or more pressure relief valves 320. These valves 320 may be used to release pressure resulting from operation of the ram accelerator 102, changes in atmospheric pressure, and so forth.

While the first ram accelerator section 124(1) and the second ram accelerator sections 124(2) are depicted in this example, it is understood that the mechanism 300 may be employed between other sections 124, at the end of other sections 124, and so forth.

In other implementations, instead of a spool, the diaphragm 304 may be arranged as plates or sheets of material. A feed mechanism may be configured to change these plates or sheets to replace penetrated diaphragms 304 with intact diaphragms.

The section separator mechanism 126 may comprise a plate configured to be slid in an out of the launch tube 116, such as a gate valve. Other valves such as ball valves may also be used. One or more of these various mechanisms may be used in the same launch tube 116 during the same firing operation. For example, the mechanism 300 may be used at the ejection end of the ram accelerator 102 while ball or gate valves may be used between the sections 124.

The section separator mechanisms 126 may be configured to fit within the guide tube 136, or be placed down within the hole 134. This arrangement allows the ram acceleration sections 124 to extend down the hole 134. For example, the mechanism 300 may be deployed down into the hole 134 to support firing of an ongoing sequence of projectiles 118 down the hole.

Figure 4:
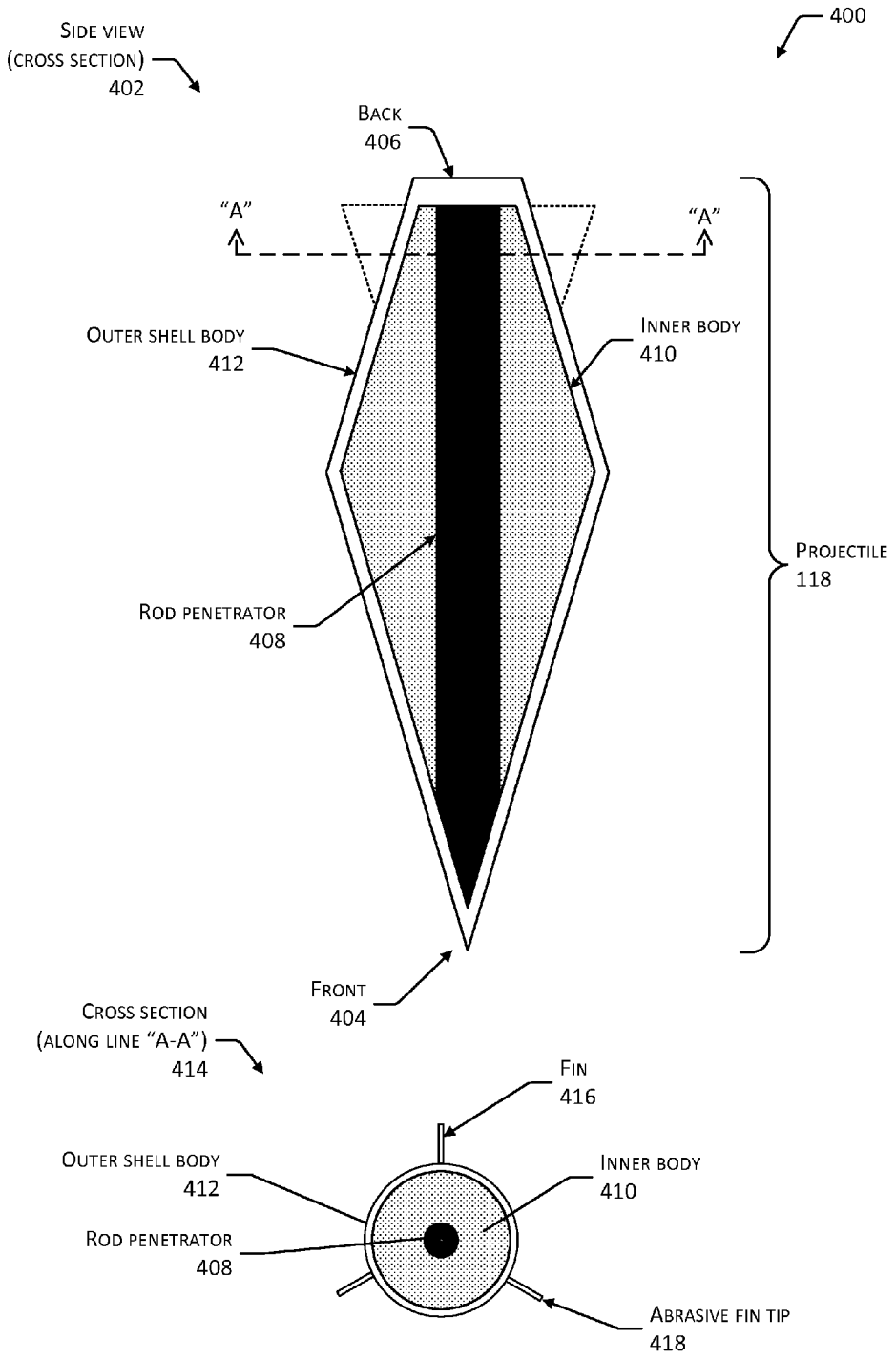
FIG. 4 illustrates a projectile configured to be accelerated using a ram combustion effect.

FIG. 4 illustrates several views 400 of the projectile 118. A side-view 402 depicts the projectile 118 as having a front 404, a back 406, a rod penetrator 408, and inner body 410, and an outer shell body 412. The front 404 is configured to exit the launch tube 116 before the back 406 during launch.

The rod penetrator 408 may comprise one or more materials such as metals, ceramics, plastics, and so forth. For example, the rod penetrator 408 may comprise copper, depleted uranium, and so forth.

The inner body 410 of the projectile 118 may comprise a solid plastic material or other material to entrain into the hole 134 such as, for example, explosives, hole cleaner, seepage stop, water, ice. For example, the projectile 118 may include a material that generates gasses to assist in the removal of ejecta from the hole 134. A plastic explosive or specialized explosive may be embedded in the rod penetrator 408. As the projectile 118 penetrates the geologic material 106, the explosive is entrained into the hole 134 where it may be detonated. In another embodiment, the outer shell body 412 may be connected to a lanyard train configured to pull a separate explosive into the hole 134.

In some implementations, at least a portion of the projectile 118 may comprise a material which is combustible during conditions present during at least a portion of the firing sequence of the ram accelerator 102. For example, the outer shell body 412 may comprise aluminum. In some implementations, the projectile 118 may omit onboard propellant.

The back 406 of the projectile 118 may also comprise an obturator 120 which is adapted to prevent the escape of the combustible gas mixture 128 past the projectile 118 as the projectile 118 accelerates through each section of the launch tube 116. The obturator 120 may be an integral part of the projectile 118 or a separate and detachable unit. Cross section 414 illustrates a view along the plane indicated by line A-A.

As depicted, the projectile 118 may also comprise one or more fins 416, rails, or other guidance features. For example, the projectile 118 may be rifled to induce spiraling. The fins 416 may be positioned to the front 404 of the projectile 118, the back 406, or both, to provide guidance during launch and ejection. The fins 416 may be coated with an abrasive material that aids in cleaning the launch tube 116 as the projectile 118 penetrates the geologic material 106. In some implementations, one or more of the fin 416 may comprise an abrasive tip 418. In some implementations, the body of the projectile 118 may extend out to form a fin or other guidance feature. The abrasive tip 418 may be used to clean the guide tube 136 during passage of the projectile 118.

During operation, the width of one or more of the ram acceleration sections 124 or the guide tubes 136 may change. For example, as the depth drilled becomes deeper, successive sections of guide tube 136 may be narrower. The fins 416 of the projectile 118 may be configured to abrade, shear, flex, compress, and so forth during transit such that the projectile 118 continues to travel along the length of the tube. In some implementations, cutting elements may be built into the tubes to shear away a portion of the fins 416. For example, a conical section including shearing surfaces may be used to transition from a wider casing to a narrower casing. As the projectile 118 travels through this conical section or "funnel", the cutting elements remove at least a portion of the fins 416 so the projectile 118 will fit into the downstream section of the guide tube 136, through a section separator mechanism 126 such as a ball valve, and so forth. For example, the downstream section of the guide tube 136 may include one or more rail tubes (described below with regard to FIG. 20). These rail tubes may be configured to guide the projectile 118, convey a particular rotation or spin to the projectile 118 during operation, and so forth. For example, the rail tubes may have a helical curve that results in the projectile 118 rotating.

In some implementations, the projectile 118 may incorporate one or more sensors or other instrumentation. The sensors may include accelerometers, temperature sensors, gyroscopes, and so forth. Information from these sensors may be returned to receiving equipment using radio frequencies, optical transmission, acoustic transmission, and so forth. This information may be used to modify the one or more firing parameters, characterize material in the hole 134, and so forth.

Figure 5:
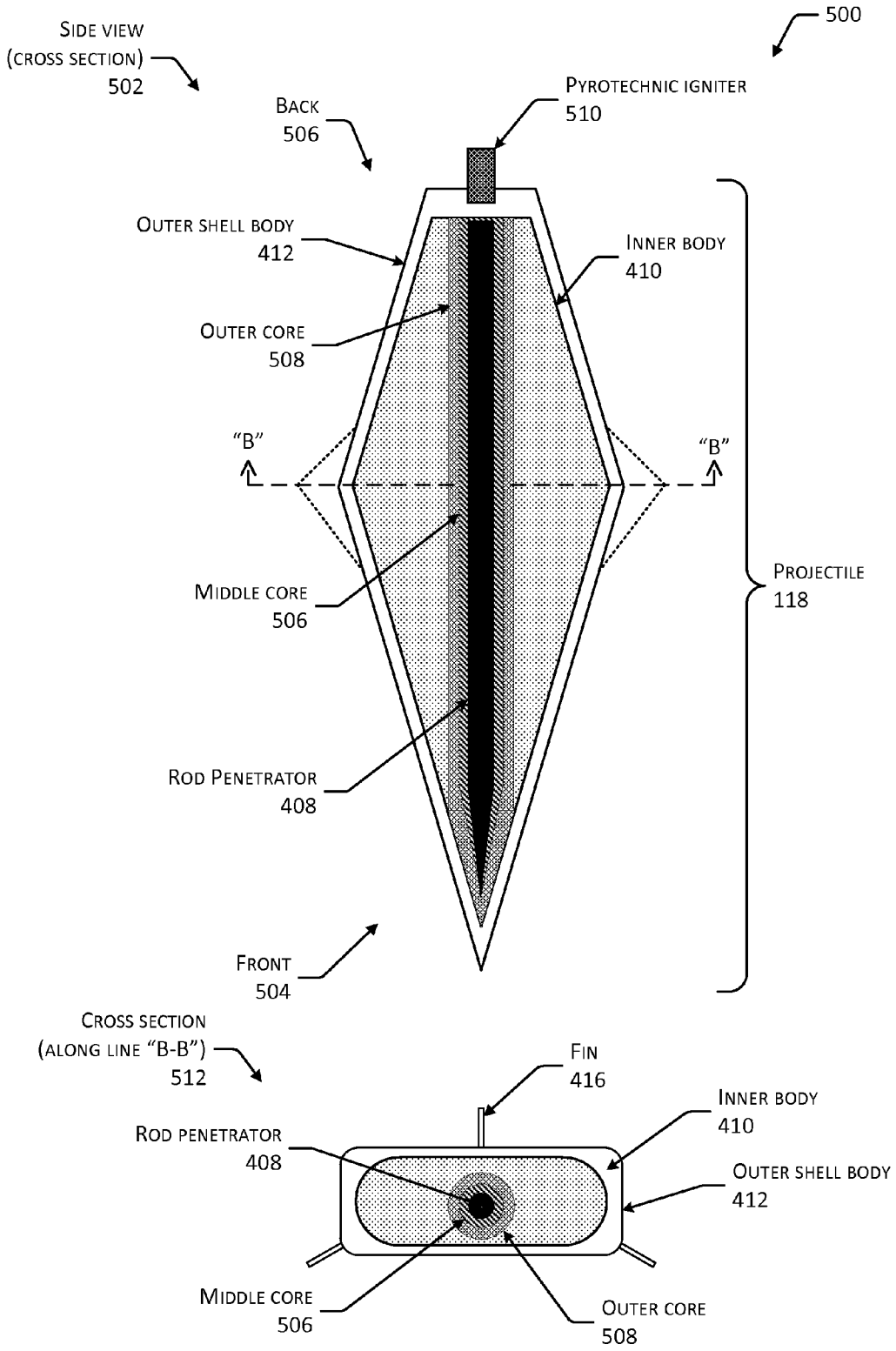
FIG. 5 illustrates a projectile configured with an abrasive inner core configured to provide abrasion of the material upon and subsequent to impact.

FIG. 5 illustrates several views 500 of another projectile 118 design. As shown here in a side view 502 showing a cross section, the projectile 118 has a front 504 and a back 506.

Within the projectile 118 is the rod penetrator 408. While the penetrator is depicted as a rod, in other implementations the penetrator may have one or more other shapes, such as a prismatic solid.

Similar to that described above, the projectile 118 may include a middle core 506 and an outer core 508. In some implementations, one or both of these may be omitted. As also described above, the projectile 118 may include the inner body 410 and the outer shell body 412, albeit with a different shape from that described above with regard to FIG. 4.

The projectile 118 may comprise a pyrotechnic igniter 510. The pyrotechnic igniter 510 may be configured to initiate, maintain, or otherwise support combustion of the combustible gas mixtures 128 during firing.

Cross section 512 illustrates a view along the plane indicated by line B-B. As depicted, the projectile 118 may not be radially symmetrical. In some implementations, the shape of the projectile 118 may be configured to provide guidance or direction to the projectile 118. For example, the projectile 118 may have a wedge or chisel shape. As above, the projectile 118 may also comprise one or more fins 416, rails, or other guidance features.

The projectile 118 may comprise one or more abrasive materials. The abrasive materials may be arranged within or on the projectile 118 and configured provide an abrasive action upon impact with the working face of the geologic material 106. The abrasive materials may include diamond, garnet, silicon carbide, tungsten, or copper. For example, a middle core 506 may comprise an abrasive material that may be layered between the inner core and the outer core 508 of the rod penetrator 408.

Figure 6:
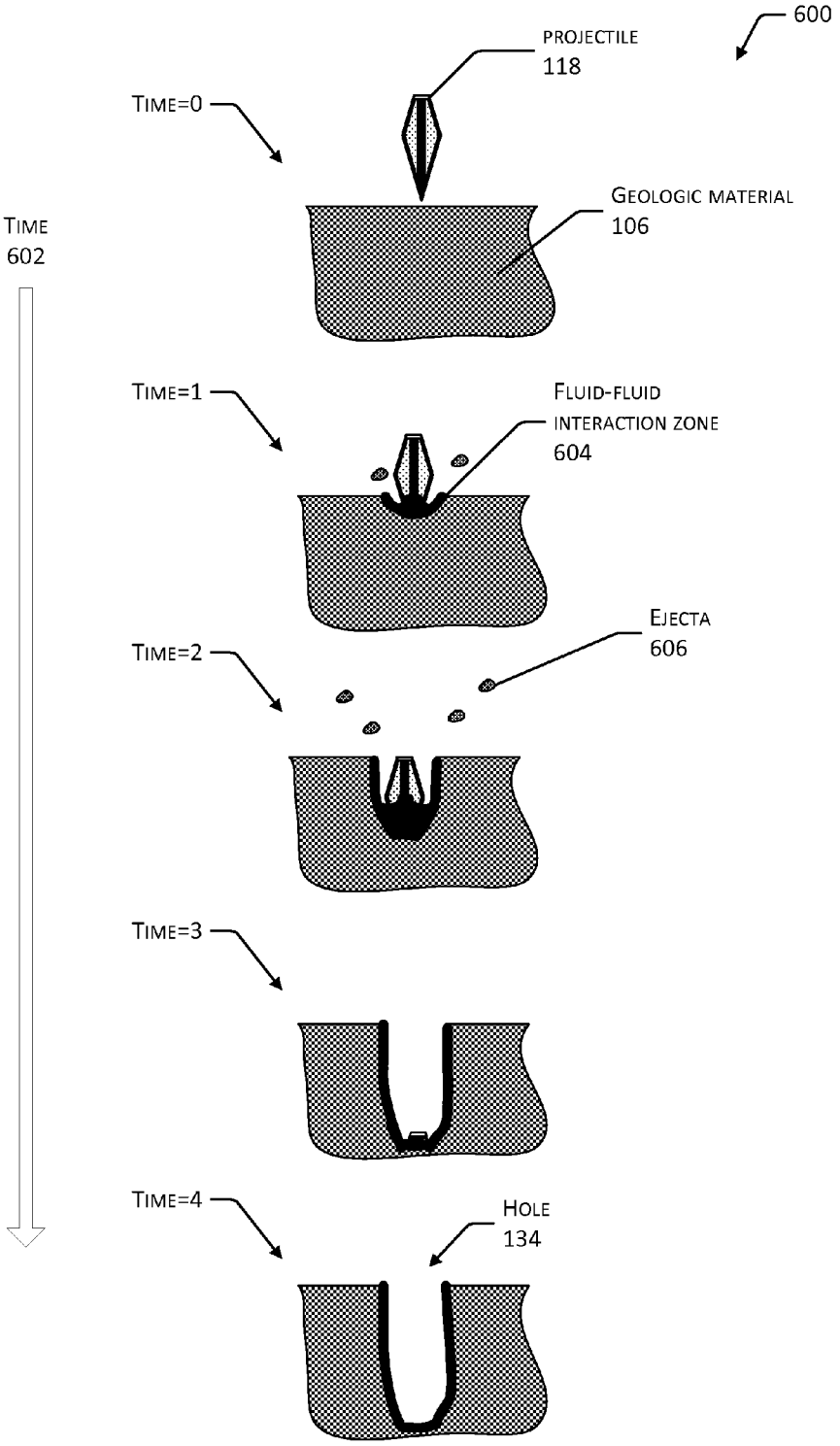
FIG. 6 illustrates a fluid-fluid impact interaction of the projectile with the geological material.

FIG. 6 illustrates a sequence 600 of a fluid-fluid impact interaction such as occurring during penetration of the working face of the geologic material 106 by the projectile 118 that has been ejected from the ram accelerator 102. In this illustration time is indicated as increasing down the page, as indicated by arrow 602.

In one implementation, a projectile 118 with a length to diameter ratio of approximately 10:1 or more is impacted at high velocity into the working surface of a geologic material 106. Other length to diameter ratios of 3:1, 4:1, and so forth may also be used. Penetration at a velocity above approximately 800 meters/sec results in a penetration depth that is on the order of two or more times the length of the projectile 118. Additionally, the diameter of the hole 134 created is approximately twice, or more, the diameter of the impacting projectile 118. Additional increases in velocity of the projectile 118 result in increases in penetration depth of the geologic material 106. As the velocity of the projectile 118 increases, the front of the projectile 118 starts to mushroom on impact with the working face of the geologic material 106. This impact produces a fluid-fluid interaction zone 604 which results in erosion or vaporization of the projectile 118. A back pressure resulting from the impact may force ejecta 606 or other material such as cuttings from the reamers from the hole 134. The ejecta 606 may comprise particles of various sizes ranging from a fine dust to chunks. In some implementations, the ejecta 606 may comprise one or more materials which are useful in other industrial processes. For example, ejecta 606 which include carbon may comprise buckyballs or nanoparticles suitable for other applications such as medicine, chemical engineering, printing, and so forth.

The higher the velocity, the more fully eroded the projectile 118 becomes and therefore the "cleaner" or emptier the space created by the high-speed impact, leaving a larger diameter and a deeper hole 134. Also, the hole 134 will have none or almost no remaining material of the projectile 118, as the projectile 118 and a portion of the geologic material 106 has vaporized.

Figure 7:
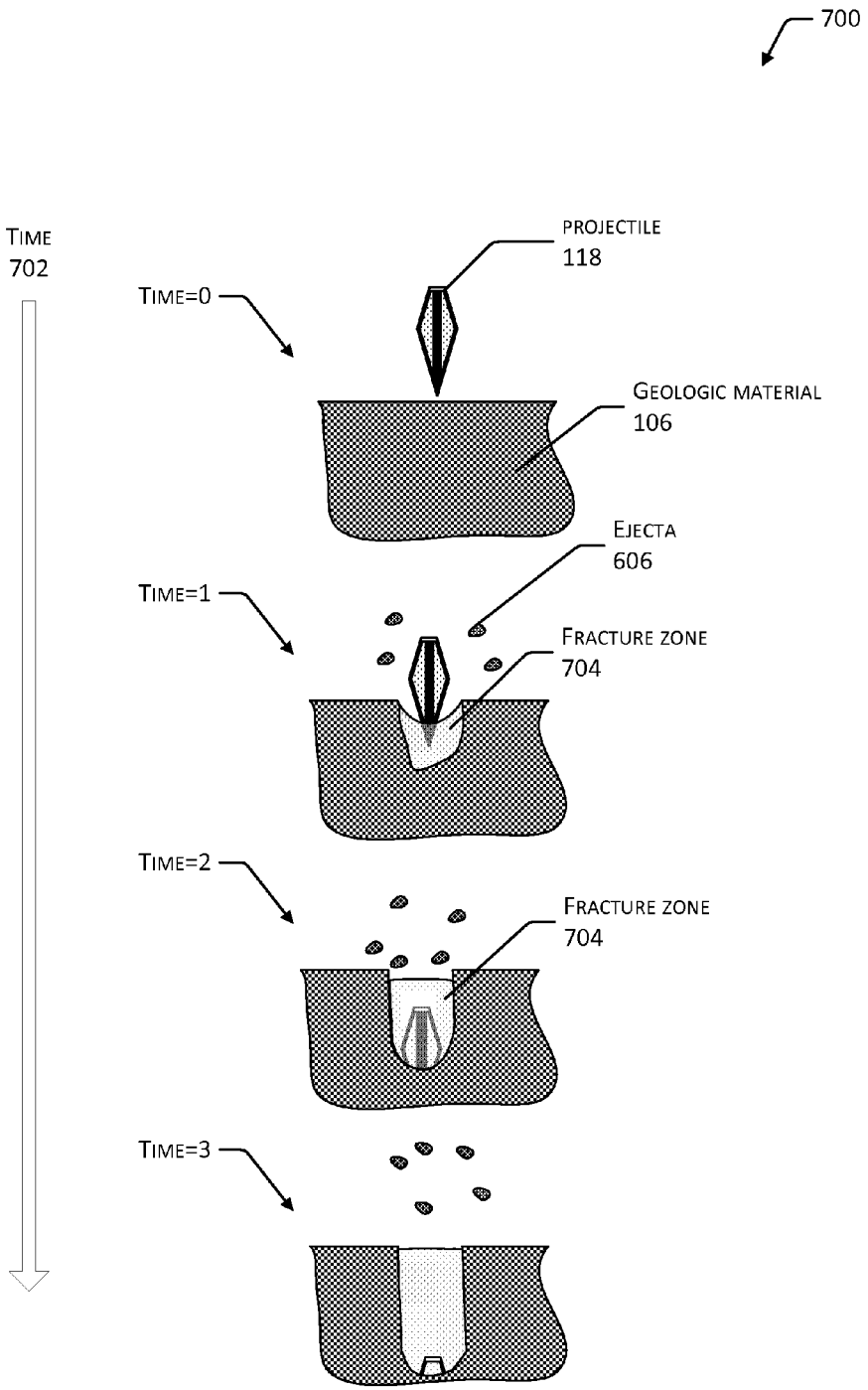
FIG. 7 illustrates a non-fluid-fluid impact interaction of the projectile with the geological material.

FIG. 7 illustrates a sequence 700 of a non-fluid-fluid interaction such as occurring during penetration of the working face of the geologic material 106 by the projectile 118 at lower velocities. This interaction may also be described as non-hydro-elastic. In this illustration time is indicated as increasing down the page, as indicated by arrow 702.

At lower velocities, such as when the projectile 118 is ejected from the ram accelerator 102 at a velocity below 2 kilometers per second, the portion of the geologic material 106 proximate to the projectile 118 starts to fracture in a fracture zone 704. Ejecta 606 may be thrown from the impact site. Rather than vaporizing the projectile 118 and a portion of the geologic material 106 as occurs with the fluid-fluid interaction, here the impact may pulverize or fracture pieces of the geological material 106. For example, a first impact may be considered to have "preconditioned" the fracture zone 704 for subsequent impacts.

As described above, a back pressure resulting from the impact may force the ejecta 606 from the hole 134.

Figure 8:
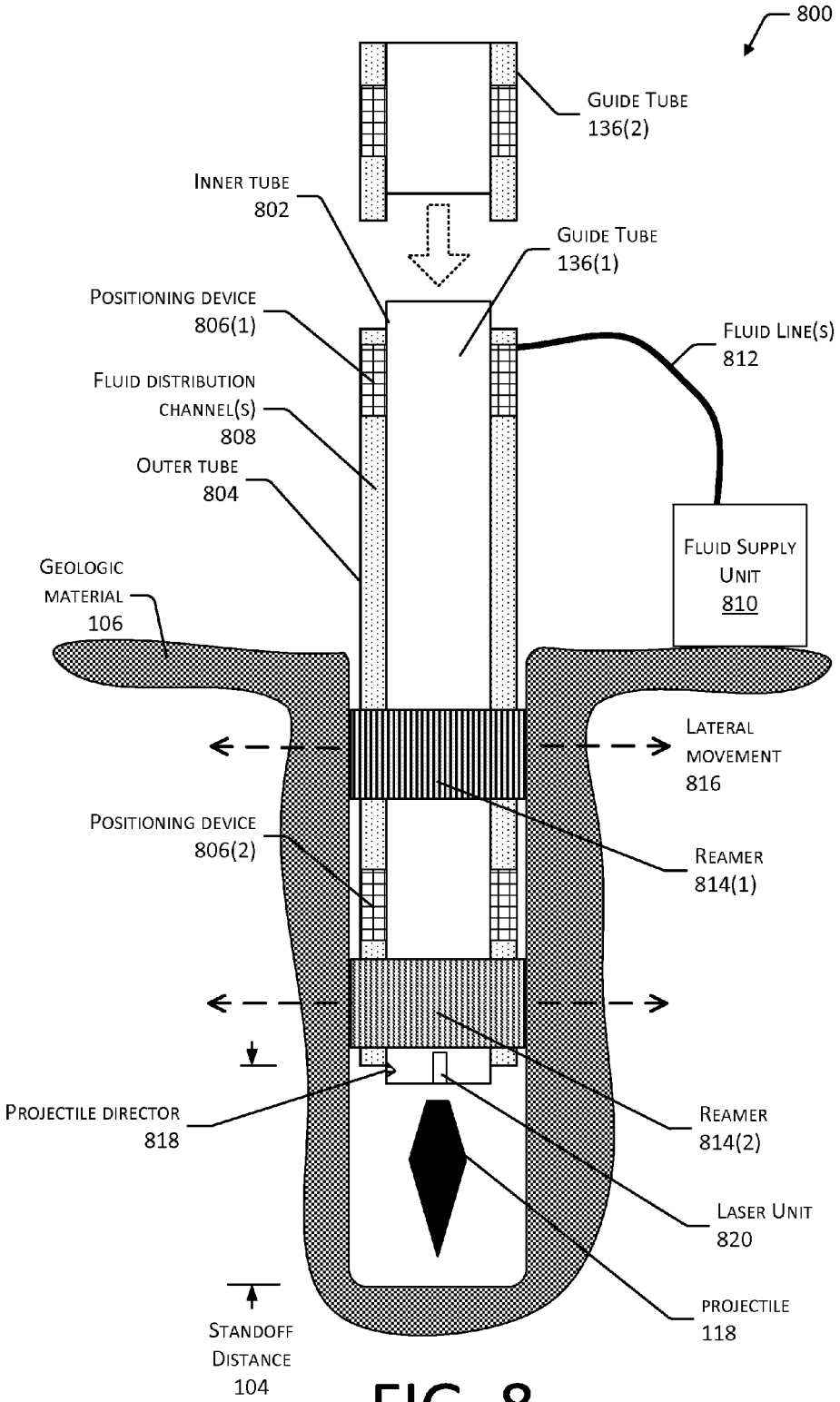
FIG. 8 illustrates additional detail associated with the guide tube, as well as reamers and other devices which may be placed downhole.

FIG. 8 illustrates a mechanism 800 including the guide tube 136 equipped with an inner tube 802 and an outer tube 804. Positioning of the inner tube 802 relative to the outer tube 804 may be maintained by one or more positioning devices 806. In some implementations, the positioning device 806 may comprise a collar or ring. The positioning device 806 may include one or more apertures or pathways to allow materials such as fluid, ejecta 606, and so forth, to pass. The positioning device 806 may be configured to allow for relative movement between the inner tube 802 and the outer tube 804, such as rotation, translation, and so forth. For example, the outer tube 804 may rotate while the inner tube 802 remains stationary.

The space between the inner tube 802 and the outer tube 804 may form one or more fluid distribution channels 808. The fluid distribution channels 808 may be used to transport ejecta 606, fluids such as cooling or hydraulic fluid, lining materials, and so forth. The fluid distribution channels 808 are configured to accept fluid from a fluid supply unit 810 via one or more fluid lines 812. The fluid distribution channels 808 may comprise a coaxial arrangement of one tube within another, the jacket comprising the space between an inner tube 802 and an outer tube 804. The fluid may be recirculated in a closed loop, or used once in an open loop.

The inner tube 802 is arranged within the outer tube 804. In some implementations, the tubes may be collinear with one another. Additional tubes may be added, to provide for additional functionality, such as additional fluid distribution channels 808.

One or more reamers 814 are coupled to the fluid distribution channels 808 and arranged in the hole 134. The reamers 814 may be configured to provide various functions. These functions may include providing a substantially uniform cross section of the hole 134 by cutting, scraping, grinding, and so forth. Another function provided by the reamer 814 may be to act as a bearing between the walls of the hole 134 and the guide tube 136. The fluid from the fluid supply unit 810 may be configured to cool, lubricate, and in some implementations power the reamers 814.

The reamers 814 may also be configured with one or more actuators or other mechanisms to produce one or more lateral movements 816. These lateral movements 816 displace at least a portion of the guide tube 136 relative to the wall of the hole 134, tilting, canting, or curving one or more portions of the guide tube 136. As a result, the impact point of the projectile 118 may be shifted. By selectively applying lateral movements 816 at one or more reamers 814 within the hole 134, the location of subsequent projectile 118 impacts and the resulting direction of the drilling path 138 may be altered. For example, the drilling path 138 may be curved as a result of the lateral movement 816.

The reamers 814, or other supporting mechanisms such as rollers, guides, collars, and so forth, may be positioned along the guide tube 136. These mechanisms may prevent or minimize Euler buckling of the guide tube 136 during operation.

In some implementations, a path of the projectile 118 may also be altered by other mechanisms, such as a projectile director 818. The projectile director 818 may be arranged at one or more locations, such as the guide tube 136, at an end of the guide tube 136 proximate to the working face of the geologic material 106, and so forth. The projectile director 818 may include a structure configured to deflect or shift the projectile 118 upon exit from the guide tube 136.

As described above, the guide tube 136, or the ram accelerator 102 when no guide tube 136 is in use, may be separated from the working face of the geologic material 106 by the standoff distance 104. The standoff distance 104 may vary based at least in part on depth, material in the hole 134, firing parameters, and so forth. In some implementations, the standoff distance 104 may be two or more feet.

As drilling progresses, additional sections of guide tube 136 may be coupled to those which are in the hole 134. As shown here, the guide tube 136(1) which is in the hole 134 may be coupled to a guide tube 136(2). In some implementations, the inner tubes 802 and the outer tubes 804 may be joined in separate operations. For example, the inner tube 802(2) may be joined to the inner tube 802(1) in the hole 134, one or more positioning devices 806 may be emplaced, and the outer tube 804(2) may be joined also to the outer tube 804(1).

In some implementations, a laser unit 820 may be utilized to impart energy into the material ahead of the projectile 118. This may be used to reduce drag on the projectile 118 while in motion. For example, the guide tube 136 may include optical fibers or laser units 820 to generate laser pulses that are fired into the path of the oncoming projectile. The reduction of drag in hypersonic projectiles is described in more detail in "Hypersonic wave drag reduction performance of cylinders with repetitive laser energy depositions" by J. Fang, Y. J. Hong, Q. Li, and H. Huang.

Figure 9:
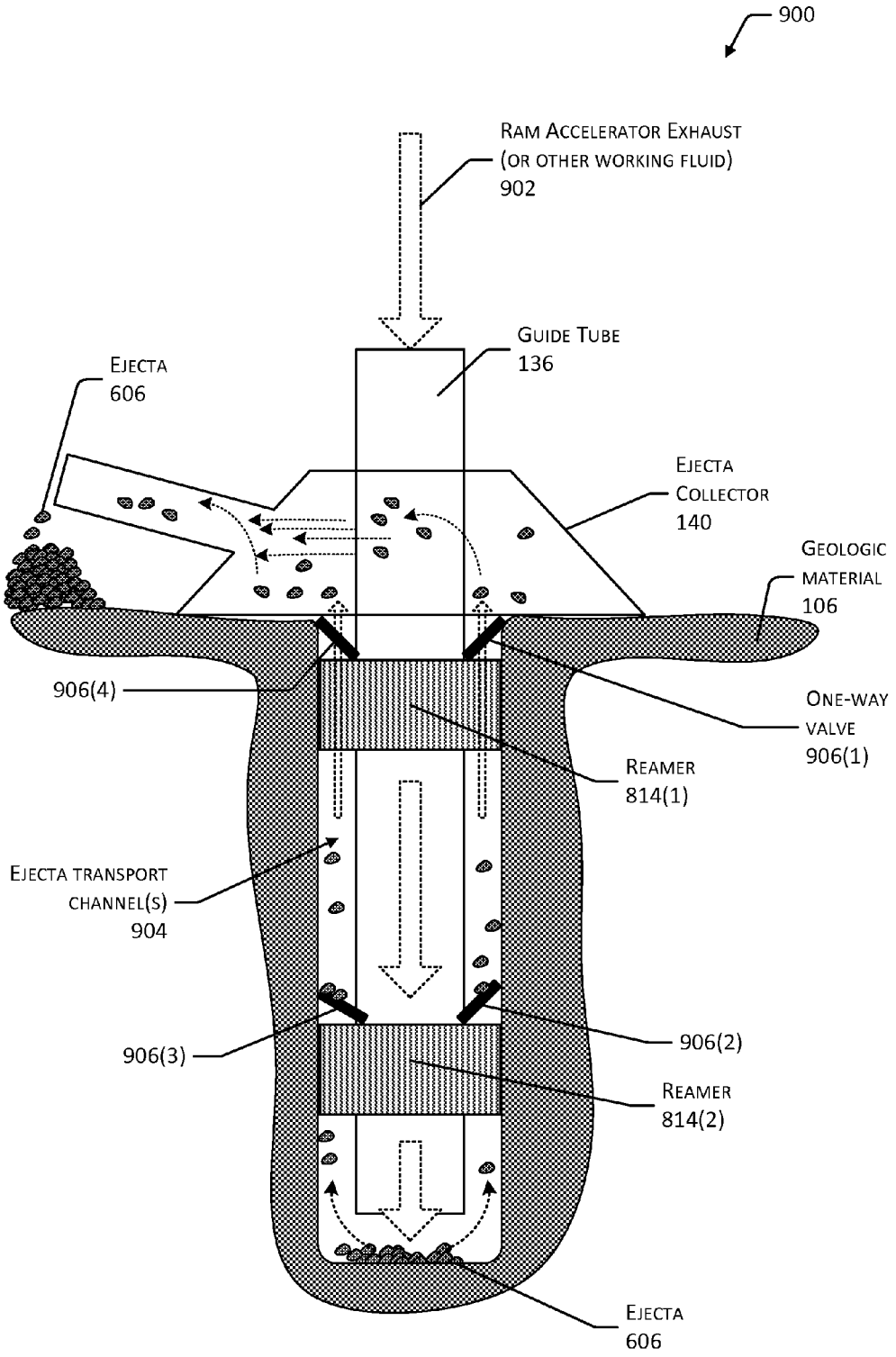
FIG. 9 illustrates a guide tube placed downhole having an ejecta collector coupled to one or more ejecta channels configured to convey ejecta from the impact aboveground for disposal.

FIG. 9 illustrates a mechanism 900 in which a fluid such as exhaust from the firing of the ram accelerator 102 is used to drive ejecta 606 or other material such as cuttings from the reamers 814 from the hole 134. In this illustration, the guide tube 136 is depicted with the one or more reamers 814. The fluid distribution channels 808 or other mechanisms described herein may also be used in conjunction with the mechanism 900.

Ram accelerator exhaust 902 ("exhaust") or another working fluid is forced down the guide tube 136. The working fluid may include air or other gasses, water or other fluids, slurries, and so forth under pressure. The exhaust 902 pushes ejecta 606 into one or more ejecta transport channels 904. In one implementation, the ejecta transport channels 904 may comprise a space between the guide tube 136 and the walls of the hole 134. In another implementation, the ejecta transport channels 904 may comprise a space between the guide tube 136 and another tube coaxial with the guide tube 136. The ejecta transport channels 904 are configured to carry the ejecta 606 from the hole 134 out to the ejecta collector 140.

A series of one-way valves 906 may be arranged within the ejecta transport channels 904. The one-way valves 906 are configured such that the exhaust 902 and the ejecta 606 are able to migrate away from a distal end of the hole 134, towards the ejecta collector 140. For example, a pressure wave produced by the projectile 118 travelling down the guide tube 136 forces the ejecta 606 along the ejecta transport channels 904, past the one-way valves 906. As the pressure subsides, larger pieces of ejecta 606 may fall, but are prevented from returning to the end of the hole 134 by the one-way valves 906. With each successive pressure wave resulting from the exhaust 902 of successive projectiles 118 or other injections or another working fluid, the given pieces of ejecta 606 migrate past successive one-way valves 906 to the surface. At the surface, the ejecta collector 140 transports the ejecta 606 for disposal.

The ejecta 606 at the surface may be analyzed to determine composition of the geologic material 106 in the hole 134. In some implementations, the projectile 118 may be configured with a predetermined element or tracing material, such that analysis may be associated with one or more particular projectiles 118. For example, coded taggants may be injected into the exhaust 902, placed on or within the projectile 118, and so forth.

Figure 10:
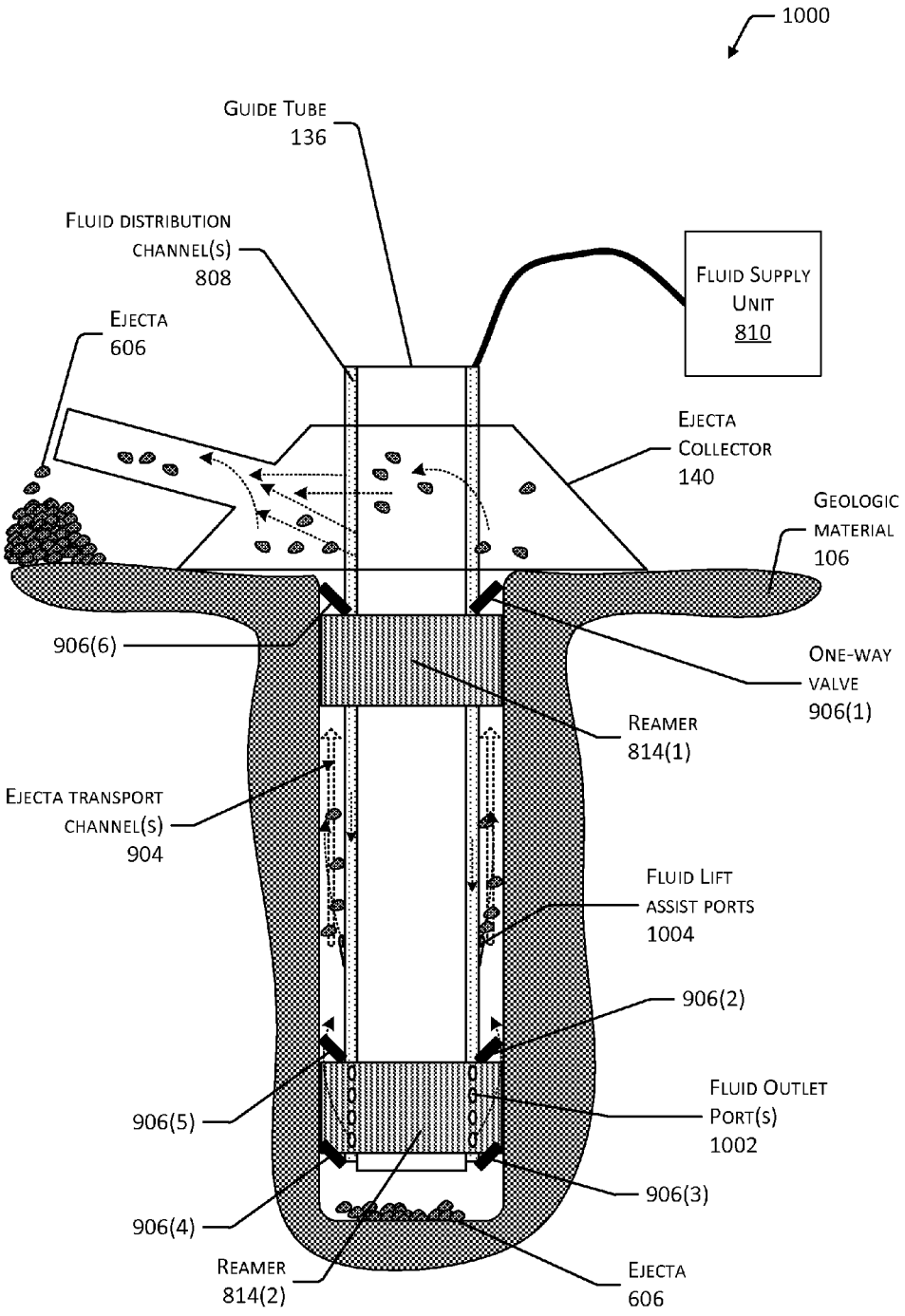
FIG. 10 illustrates a guide tube placed downhole having a reamer configured to be cooled by a fluid which is circulated aboveground to remove at least a portion of the ejecta.

FIG. 10 illustrates a mechanism 1000 for using fluid to operate the reamers 814 or other devices in the hole 134 and remove ejecta 606. As described above, the guide tube 136 may be equipped with one or more fluid distribution channels 808. The fluid distribution channels 808 may be configured to provide fluid from the fluid supply unit 810 to one or more devices or outlets in the hole 134.

In this illustration, one or more of the reamers 814 are configured to include one or more fluid outlet ports 1002. The fluid outlet ports 1002 are configured to emit at least a portion of the fluid from the fluid distribution channels 808 into the hole 134. This fluid may be used to carry away ejecta 606 or other material such as cuttings from the reamers 814. As described above, a series of one-way valves 906 are configured to direct the ejecta 606 or other debris towards the ejecta collector 140. In some implementations, fluid lift assist ports 1004 may be arranged periodically along the fluid distribution channels 808. The fluid lift assist ports 1004 may be configured to assist the movement of the ejecta 606 or other debris towards the ejecta collector 140 by providing a jet of pressurized fluid. The fluid outlet ports 1002, the fluid lift assist ports 1004, or both may be metered to provide a fixed or adjustable flow rate.

The motion of the fluid containing the ejecta 606 or other debris from the fluid outlet ports 1002 and the fluid lift assist ports 1004 may work in conjunction with pressure from the exhaust 902 to clear the hole 134 of ejecta 606 or other debris. In some implementations various combinations of projectile 118 may be used to pre-blast or clear the hole 134 of debris prior to firing of a particular projectile 118.

As described above, the ram accelerator 102 may work in conjunction with conventional drilling techniques. In one implementation, the end of the guide tube 136 in the hole 134 may be equipped with a cutting or guiding bit. For example, a coring bit may allow for core sampling.

Figure 11:
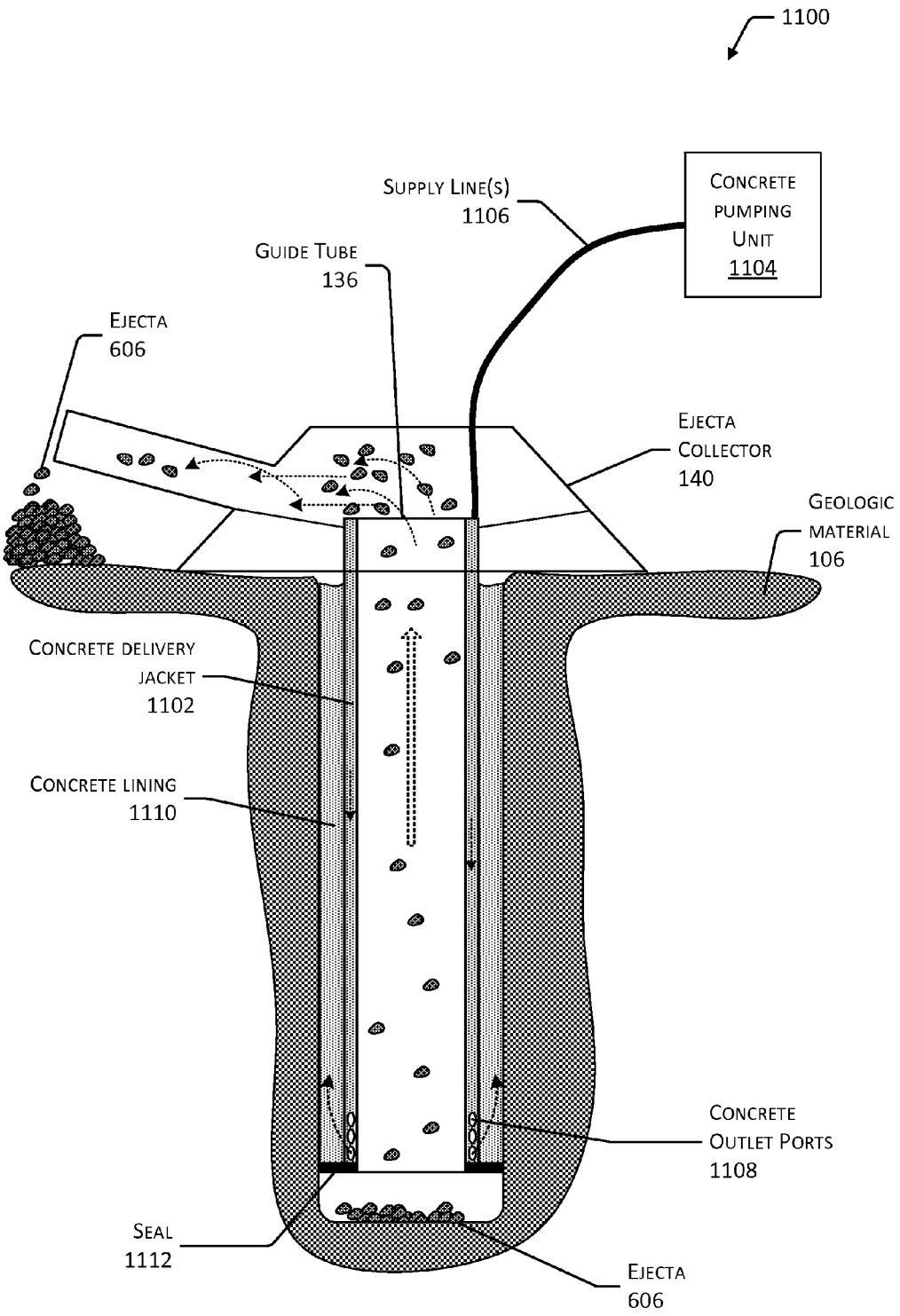
FIG. 11 illustrates a guide tube placed downhole deploying a continuous concrete lining within the hole.

FIG. 11 illustrates a mechanism 1100 in which a lining is deployed within the hole 134. A concrete delivery jacket 1102 or other mechanism such as piping is configured to accept concrete from a concrete pumping unit 1104 via one or more supply lines 1106. The concrete flows through the concrete delivery jacket 1102 to one or more concrete outlet ports 1108 within the hole 134. The concrete is configured to fill the space between the walls of the hole 134 and the guide tube 136. Instead of, or in addition to concrete, other materials such as Bentonite, agricultural straw, cotton, thickening agents such as guar gum, xanthan gum, and so forth may be used.

As drilling continues, such as from successive impacts of projectile 118 fired by the ram accelerator 102, the guide tube 136 may be inserted further down into the hole 134, and the concrete may continue to be pumped and extruded from the concrete outlet ports 1108, forming a concrete lining 1110. In other implementations, material other than concrete may be used to provide the lining of the hole 134.

In some implementations, a seal 1112 may be provided to minimize or prevent flow of concrete into the working face of the hole 134 where the projectiles 118 are targeted to impact. The mechanisms 1100 may be combined with the other mechanisms described herein, such as the reamer mechanisms 800, the ejecta 606 removal mechanisms 900 and 1000, and so forth.

In one implementation, the concrete may include a release agent or lubricant. The release agent may be configured to ease motion of the guide tube 136 relative to the concrete lining 1110. In another implementation, a release agent may be emitted from another set of outlet ports. A mechanism may also be provided which is configured to deploy a disposable plastic layer between the guide tube 136 and the concrete lining 1110. This layer may be deployed as a liquid or a solid. For example, the plastic layer may comprise polytetrafluoroethylene ("PTFE"), polyethylene, and so forth.

In some implementations, a bit or other cutting tool may be affixed to a tip of the guide tube 136. For example, a tri-cone drill may be affixed to an end of the guide tube 136. The cutting tool may have an aperture through which the projectile 118 may pass and impact the working face. The cutting tool may be in operation during impact, or may be idle during impact.

Figure 12:
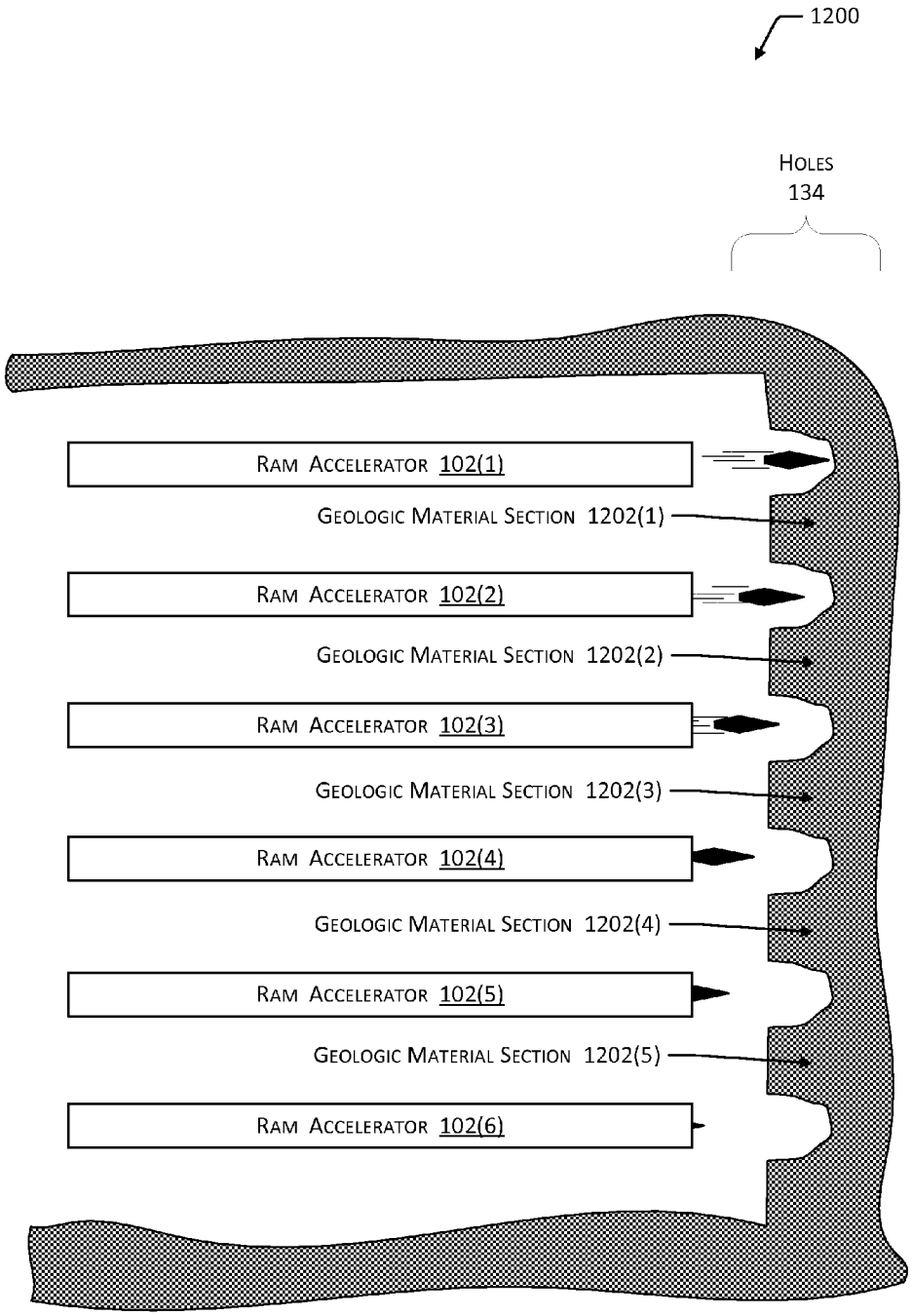
FIG. 12 illustrates tunnel boring or excavation using a ram accelerator to drill a plurality of holes using a plurality of projectiles.

FIG. 12 illustrates a mechanism 1200 for tunnel boring or excavation using one or more ram accelerators 102. A plurality of ram accelerators 102(1)-(N) may be fired sequentially or simultaneously to strike one or more target points on the working face, forming a plurality of holes 134. The impacts may be configured in a predetermined pattern which generates one or more focused shock waves within a geological material 106. These shock waves may be configured to break or displace the geological material 106 which is not vaporized on impact.

As shown here, six ram accelerators 102(1)-(6) are arranged in front of the working face. One or more projectiles 118 are launched from each of the ram accelerators 102, forming corresponding holes 134(1)-(6). The plurality of ram accelerators 102(1)-(N) may be moved in translation, rotation, or both, either as a group or independently, to target and drill the plurality of holes 134 in the working face of the geologic material 106.

In another implementation, a single ram accelerator 102 may be moved in translation, rotation, or both, to target and drill the plurality of holes 134 in the working face of the geologic material 106.

After the holes 134 are formed from impacts of the projectiles 118, various techniques may be used to remove pieces or sections of geologic material 106. The sections of geologic material 1202 are portions of the geologic material 106 which are defined by two or more holes which are proximate to one another. For example, four holes 134 arranged in a square define a section of the geologic material 106 which may be removed, as described below with regard to FIG. 13.

As described above, use of the ram accelerated projectile 118 allows for rapid formation of the holes 134 in the geologic material 106. This may result in reduced time and cost associated with tunnel boring.

Figure 13:
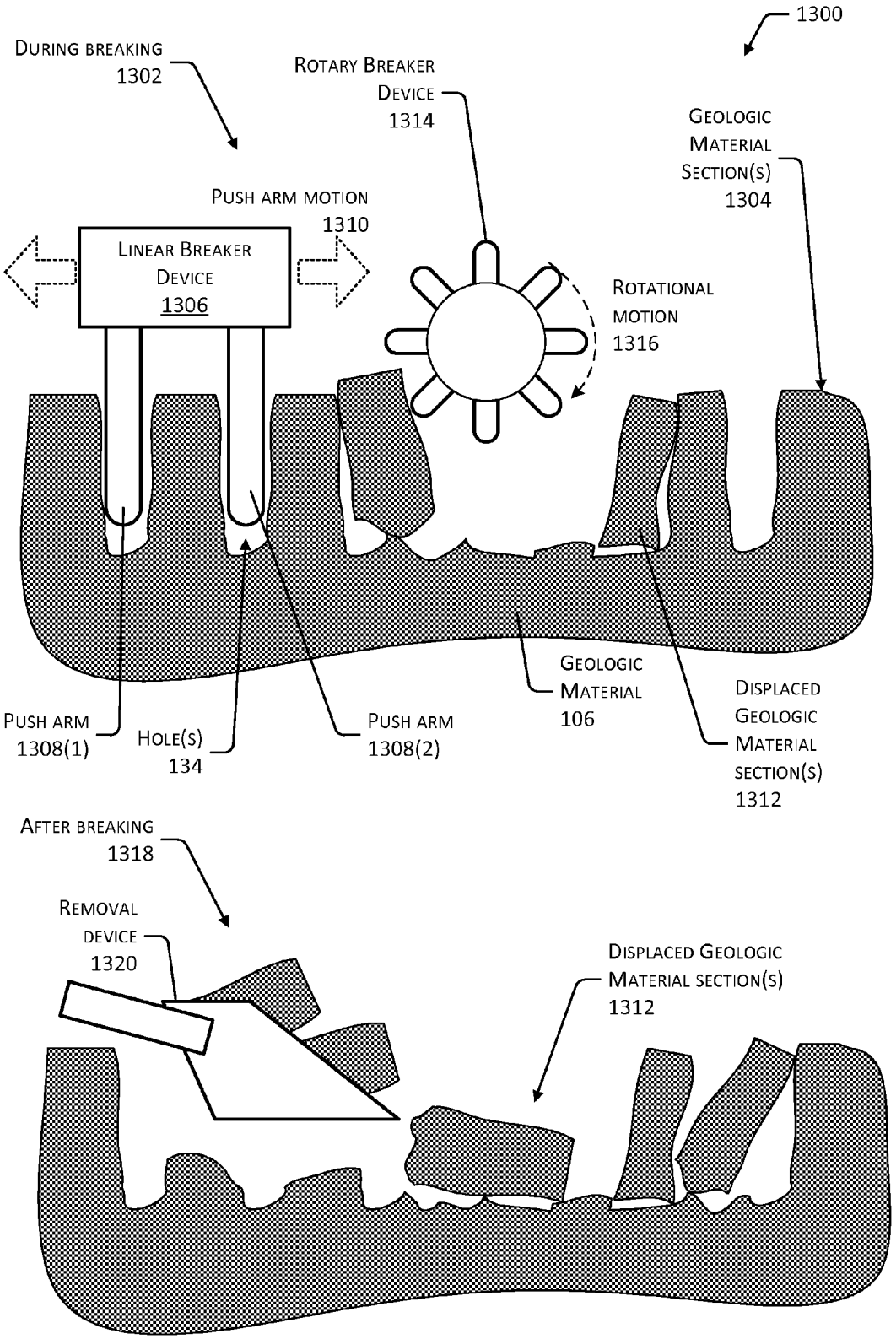
FIG. 13 illustrates devices to remove rock sections defined by holes drilled by the ram accelerator projectiles.

FIG. 13 illustrates devices and processes 1300 to remove rock sections defined by holes 134 drilled by the ram accelerator projectiles 118 or conventional drilling techniques. During breaking 1302, the ram accelerator 102 may include a mechanism which breaks apart the geologic material sections 1304. For example, the ram accelerator 102 may comprise a linear breaker device 1306 that includes one or more push-arms 1308 that move according to a push-arm motion 1310. The push-arms 1308 may be inserted between the geologic material sections 1304 and mechanical force may be applied by push arms 1308 to snap, break, or otherwise free pieces of the geologic material 106 from a main body of the geologic material 106 at the working face, forming displaced geologic material sections 1312.

In some implementations a rotary breaker device 1314 that moves according to the rotary motion 1316 may be used instead of, or in addition to, the linear breaker device 1306. The rotary breaker device 1314 breaks apart the geologic material sections 1304 by applying mechanical force during rotation. After breaking 1318, a removal device 1320 transports the displaced geologic material sections 1312 from the hole 134. For example, the removal device 1320 may comprise a bucket loader.

Illustrative Processes

Figure 14:
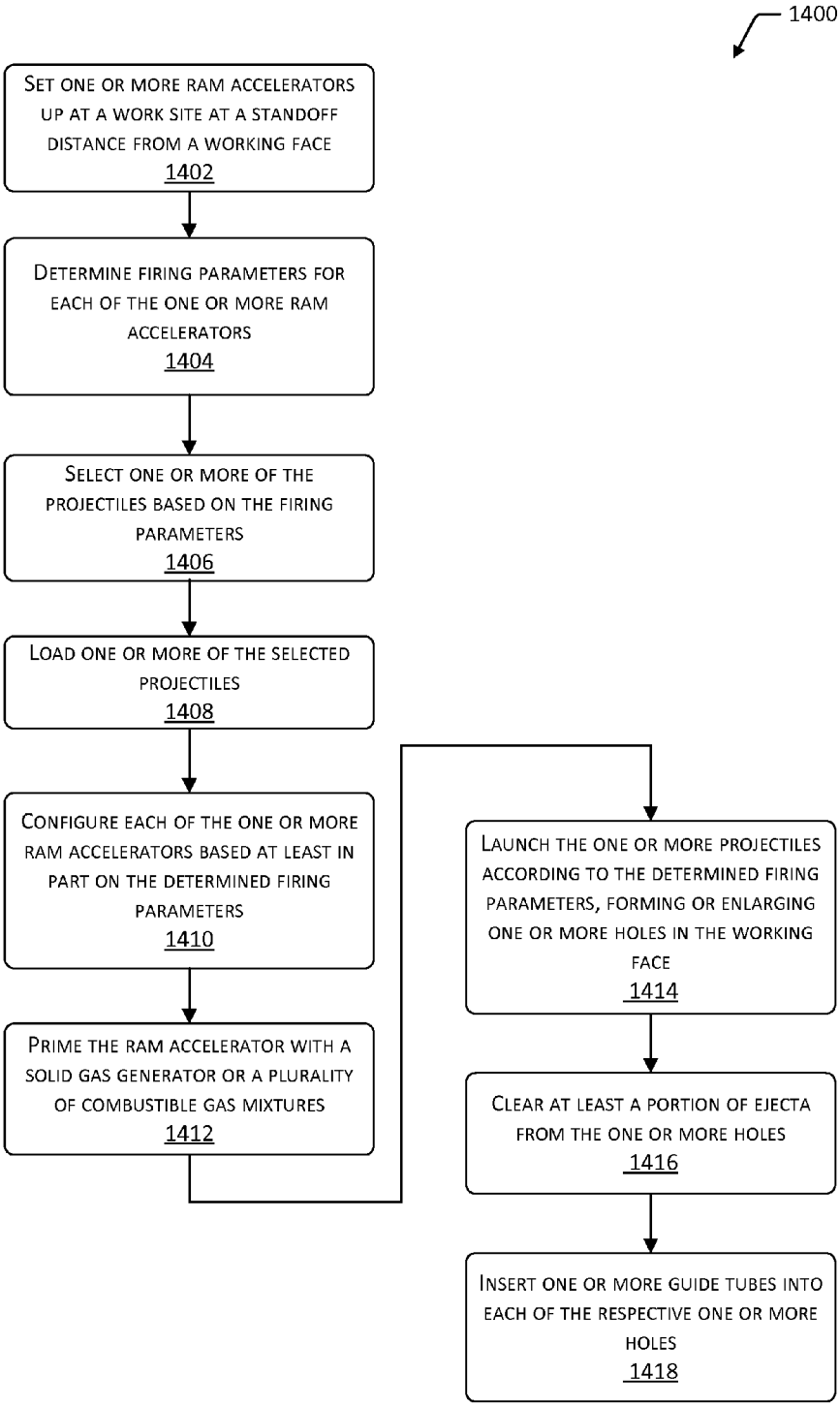
FIG. 14 is a flow diagram of a process of drilling a hole using a ram accelerator.

FIG. 14 is flow diagram 1400 of an illustrative process 1400 of penetrating geologic material 106 utilizing a hypervelocity ram accelerator 102. At block 1402, one or more ram accelerators 102 are set up at a work site 202 to drill several holes for tunnel boring, excavation, and so forth. The ram accelerators 102 may be positioned vertically, horizontally, or diagonally at a stand-off distance from the working face of the geologic material 106 to be penetrated.

At block 1404, once the ram accelerators 102 are positioned, the firing parameters, such as projectile 118 type and composition, hardness and density of the geologic material 106, number of stages in the respective ram accelerator, firing angle as well as other ambient conditions including air pressure, temperature, for each of the ram accelerators 102 is determined. At block 1406, upon a determination of the firing parameters one or more projectiles 118 is selected based at least in part on the firing parameters and the selected one or more projectiles 118 is loaded into the ram accelerator 102 as described at block 1408.

At block 1410, each of the ram accelerators 102 is configured based at least in part on the determined firing parameters. At block 1412, each of the ram accelerators 102 is then primed with either a solid gas generator or a plurality of combustible gas mixtures 128. At block 1414, after priming the one or more ram accelerators 102, one or more of the loaded projectiles 118 is launched according to the determined firing parameters. For example, a projectile 118 is boosted to a ram velocity down the launch tube 116 and through the multiple sections and ejected from the ram accelerator 102 forming or enlarging one or more holes 134 in the working face of the geologic material 106.

At block 1416, at least a portion of the ejecta is cleared from the one or more holes 134 in the working face. As described above, a back pressure resulting from the impact may force the ejecta 606 from the hole 134. In some implementations, a working fluid such as compressed air, water, and so forth may be injected into the hole 134 to aid in removal of at least a portion of the ejecta 606. Each of the holes 134 formed by the impact of the projectile 118 at hypervelocity may be further processed.

At block, 1418, a guide tube 136 may be inserted into the hole 134 to prevent subsidence, deploy instrumentation, and so forth. In one implementation, a reamer 814 coupled to a guide tube 136 may be inserted down the hole 134 and configured to provide a substantially uniform cross section.

Figure 15:
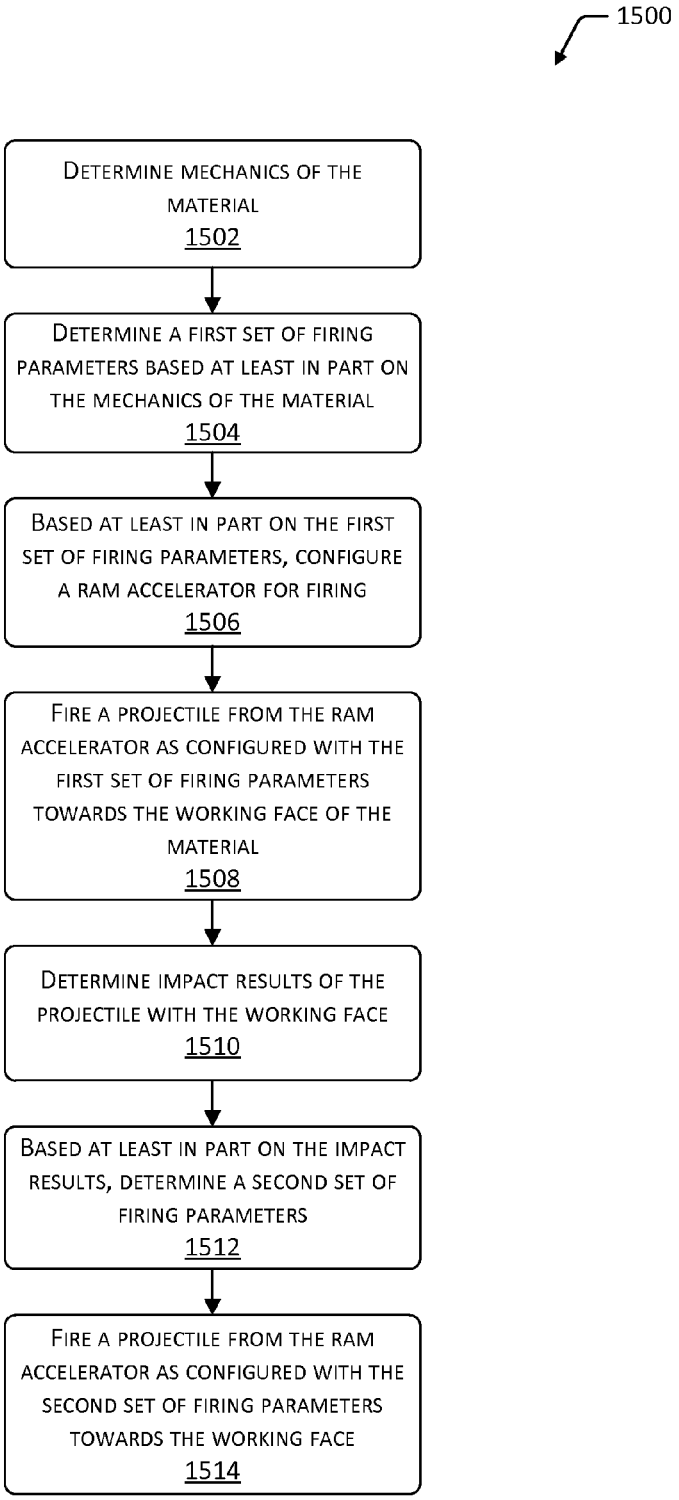
FIG. 15 is a flow diagram of a process of multiple firings of a plurality of projectiles with firing patterns adjusted between at least some of the firings.

FIG. 15 is an illustrative process 1500 of penetrating geologic material 106 utilizing a hypervelocity ram accelerator 102 to fire multiple projectiles 118 down a single hole 134 such that the hole 134 is enlarged as subsequent projectile 118 penetrate deeper into the geologic material 106. At block 1502, the mechanics of the geologic material 106 are determined. At block 1504, an initial set of firing parameters is determined based at least in part on the mechanics of the geologic material 106. At block 1506, the ram accelerator 102 is configured for firing based at least in part on the initial set of firing parameters. Once the ram accelerator 102 is configured, at block 1508, the projectile 118 is fired toward the working face of the geologic material 106 forming one or more holes 134. At block 1510, the impact results of the projectile 118 with the working face are determined. In some embodiments, the ram accelerator 102 may need to be reconfigured before loading and firing a subsequent projectile 118 into the hole 134. At block 1512, a second set of firing parameters is determined based at least in part on the impact results. At block 1514, a subsequent projectile 118 is fired from the ram accelerator 102 as configured with the second set of firing parameters towards the working face of the geologic material 106. This process may be repeated until the desired penetration depth is reached.

Figure 16:
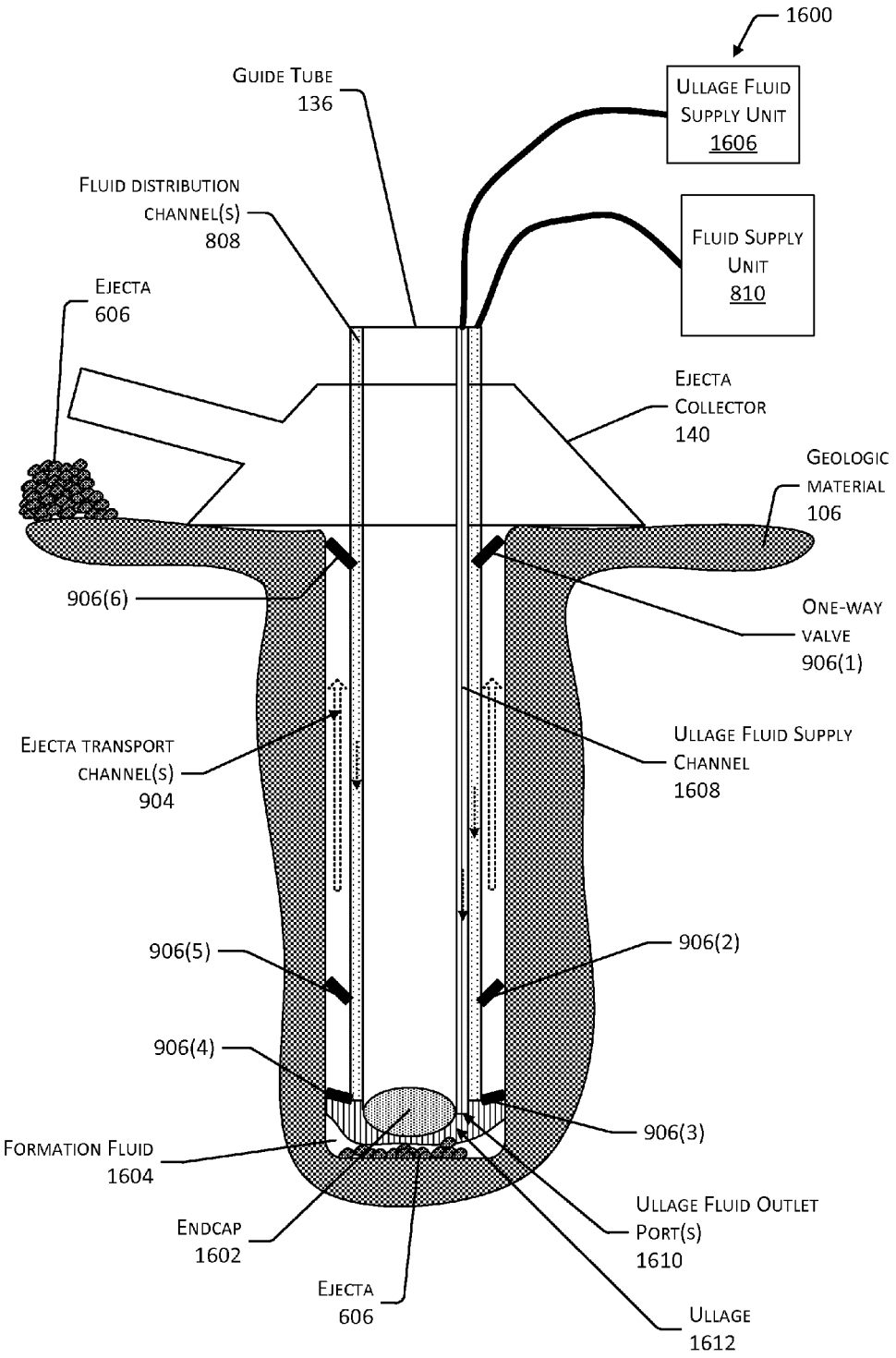
FIG. 16 illustrates a guide tube placed downhole with an endcap deployed and a system for creating an ullage in formation fluid in the hole.

FIG. 16 illustrates a mechanism 1600 comprising a guide tube 136 placed downhole with an endcap deployed and a system for creating a ullage in formation fluid in the hole. In this illustration, the guide tube 136 is depicted. However, in other implementations, the mechanisms described may be used in conjunction with other sections of the system. An endcap 1602 may be placed within the guide tube 136 to provide at least a partial seal between an interior of the guide tube 136 down which the projectile 118 may pass and a formation fluid 1604 which may accumulate at the working face within the hole 134. For example, the formation fluid 1604 may include drilling mud, oil, water, mud, gas, and so forth.

The endcap 1602 may be made of one or more of: a plastic, a polymer, a ceramic, an elastomer, a metal, or a composite material. In some implementations the endcap may also comprise a combustible material. The endcap 1602 may be rigid, flexible, semi-flexible, and so forth.

In some implementations, the endcap 1602 may be made at least in part of material configured to expand or swell. For example, the endcap 1602 may comprise a water-permeable covering filled with a hydrophilic material such as silicone gel. Other materials such as calcium hydroxide, vitreous silica, diiron trioxide, aluminum oxide, and so forth may also be used. Upon exposure to water within the formation fluid 1604, the endcap 1602 may swell, sealing the guide tube 136.

The endcap 1602 may be deployed in a variety of shapes. These shapes may include, but are not limited to, a cylinder, a sphere, a lens, and so forth. In some implementations the endcap may include a concavity, configured to accept the projectile 118. For example, the concavity may be in the center of the endcap 1602.

The endcap 1602 may comprise a structure configured to change from a first physical configuration to a second physical configuration. The second physical configuration may exhibit a greater width than the first physical configuration. For example, the first physical configuration may be folded or stowed, while the second physical configuration is expanded or deployed. For example, the endcap 1602 may comprise a number of mechanical members which may be displaced such that they provide a radial pressure, increasing a diameter of the endcap, such that the seal is formed.

In one implementation, the endcap 1602 may be deployed to an end of the guide tube 136 which is proximate to the working face. The endcap 1602 may form at least a partial seal, preventing or impeding flow of the formation fluid 1604 into the portion of the guide tube 136 within which the projectile 118 travels.

A ullage fluid supply unit 1606 is configured to provide a ullage fluid or purge gas by way of one or more ullage fluid supply channels 1608 to one or more ullage fluid outlet ports 1610 which are proximate to the working face. The ullage fluid may comprise a gas or a liquid. Gas ullage fluids may include, but are not limited to, helium, hydrogen carbon dioxide, nitrogen, and so forth. In some implementations the ullage fluid may be combustible or detonable, such as the combustible gas mixture 128 described above.

The ullage fluid may be injected into a volume which is bounded at least in part by the endcap 1602 and the working face. The ullage fluid may be applied at a pressure which is equal to or greater than the pressure of the surrounding formation fluid 1604. The ullage fluid is injected to form a ullage 1612, or pocket within the formation fluid 1604. For example, where the ullage fluid comprises a gas, the ullage 1612 comprises a space or bubble which is occupied by the gas, displacing at least some of the formation fluid 1604. This displacement may reduce or prevent the incursion of the formation fluid 1604 or components thereof from the hole 134. The pocket may occupy the entire volume between the proximate portion of the drilling equipment and the working face, or a portion thereof. The ullage 1612 provides a compressible volume within which pieces of ejecta 606 and other impact products may be dispersed, at least temporarily.

In one implementation, the ullage fluid may be applied in a transient or "burp" mode, generating the ullage 1612 for a brief period of time. While the ullage 1612 is in existence, the ram accelerator 102 may be configured to fire the projectile 118 through the endcap 1602, the ullage 1612, and into the working face.

In some implementations, the ram accelerator 102 may utilize a baffle-tube ram accelerator configuration, also known as a "baffled-tube" ram accelerator. The baffled-tube ram accelerator may comprise a series of baffles or annular rings configured to control displacement of the combustible gas mixture 128 during passage of the projectile 118. The baffled-tube ram accelerator may be used instead of, or in addition to the section separator mechanism 126 described above.

In one implementation the endcap 1602 may provide the ullage 1612, displacing at least a portion of the formation fluid 1604. The endcap 1602 may comprise a foam, expanded matrix, balloon, a structure which is configured to expand and maintain a seal with the guide tube 136, and so forth. For example, the endcap 1602 may comprise a ball having a diameter greater than or equal to the diameter of the internal diameter of the guide tube 136, providing for a friction fit between the endcap 1602 and the guide tube 136. In some implementations, the endcap 1602 may comprise a combustible material. The endcap 1602 may be configured to come into contact with the working face, such as the ejecta 606, or may be separated from the working face by the formation fluid 1604 prior to creation of the ullage 1612. In other implementations, the endcap 1602 may remain within the guide tube 136.

In some implementations, a plurality of endcaps 1602 may be employed within the guide tube 136, within the ram accelerator 102, and so forth. For example, endcaps 1602 may be configured to perform one or more functions similar to, or the same as, the section separator mechanism 126.

In some implementations instead of applying ullage fluid to create the ullage 1612, a chemical or pyrotechnic device may be used. For example, pyrotechnic gas generator charges may be deployed and configured to generate gas, forming the ullage 1612 in the formation fluid 1604. In another example, a chemical gas generator may be configured to emit a gas upon contact with a reactant, such as a component of the formation fluid 1604.

The projectile 118 may be configured to generate the ullage fluid. For example, the tip of the projectile 118 may be configured to vaporize and emit a gas, such that the ullage is formed 1612.

The control system 144 may coordinate operation of one or more of the ram accelerator 102, the fluid supply unit 810, or the ullage fluid supply unit 1606. For example, the control system 144 may be configured to provide a surge or temporary increase in pressure to the fluid being distributed down the hole 134 prior to or during firing of the ram accelerator 102. Similarly, the ullage fluid supply unit 1606 may be configured to provide the ullage fluid to form the ullage 1612 prior to impact of the projectile 118.

In one implementation, the endcap 1602 may be destroyed upon impact of the projectile 118. In another implementation, the endcap 1602 may remain at least partially in place, and may continue to provide the ullage 1612 after a first penetration by the projectile 118. For example, the projectile 118 may pass through the endcap 1602 to subsequently impact at least a portion of the working face.

The endcap 1602 may be deployed to the desired position in a variety of ways. In a first implementation, the endcap 1602 may be drawn by gravity to the end of the guide tube 136. In a second implementation, a positive fluid pressure may be applied at a first end of the guide tube 136, to draw or push the endcap 1602 to the end of the guide tube 136 that is proximate to the working face. In a third implementation, a negative fluid pressure may be applied outside of the end of the guide tube 136 that is proximate to the working face to draw the endcap 1602 to the second end of the guide tube 136. In a fourth implementation, the endcap 1602 may be pushed to the end of the guide tube 136 proximate to the working face with a mechanical member.

A sequence of ball valves or other section separator mechanisms 126 may be actuated to permit the endcap 1602 to progress to the desired location, such as a portion of the tube which is proximate to the working face.

In some implementations, an auger or other mechanism may be provided which is configured to remove ejecta 606 from the volume proximate to the working face. For example, the end of the guide tube 136 may have one or more auger blades affixed such that rotation moves the ejecta 606 away from the working face and into the ejecta transport channels 904.

Figure 17:
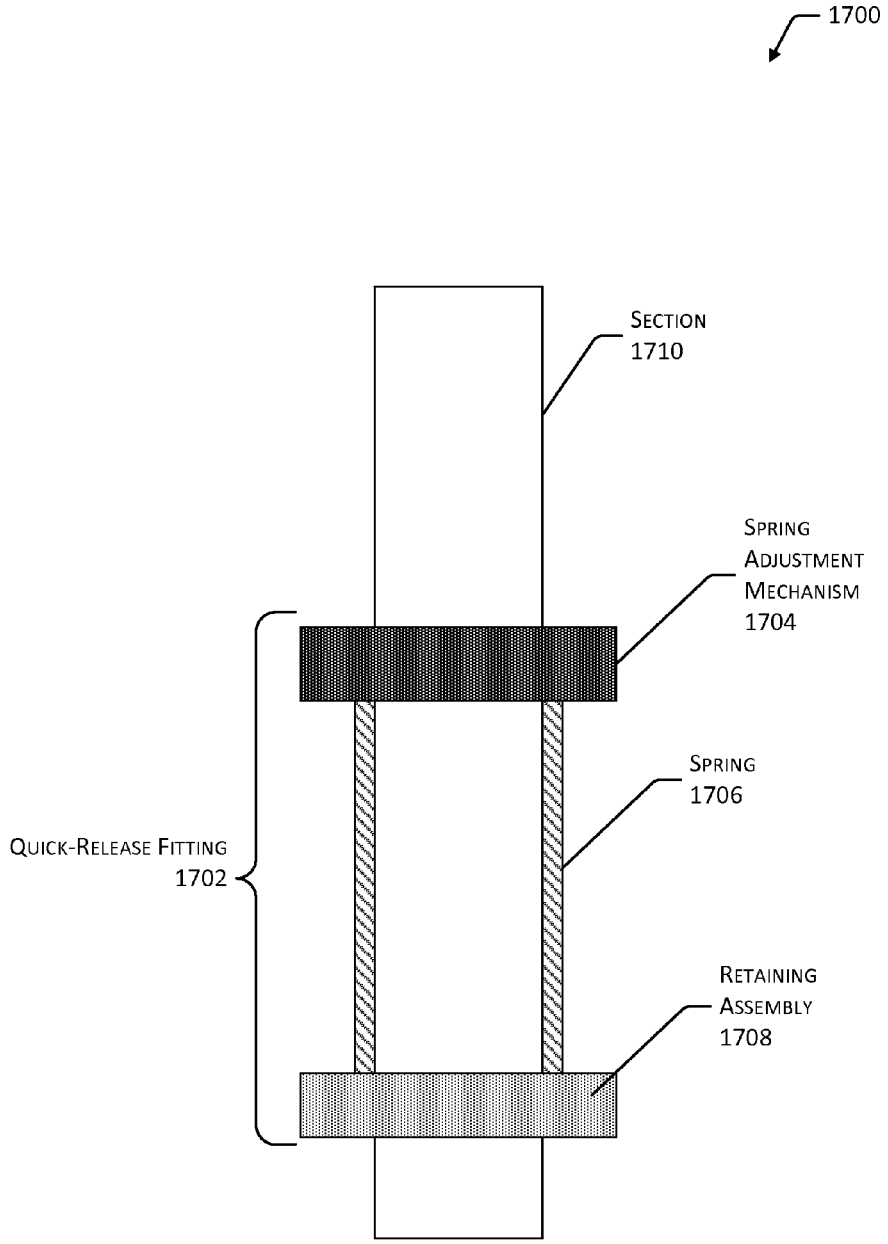
FIG. 17 illustrates a quick-release fitting for restraining an object in the system.

FIG. 17 illustrates a mechanism 1700 comprising a quick-release fitting ("QRF") 1702 for use in system 100. The QRF 1702 or portions thereof may be mounted around, within, or around and within another structure such as a casing. The QRF 1702 may be used to restrain an obturator 120 prior to firing, an endcap 1602, or other object within the system 100. The obturator 120 may be in place of, or in addition to, a breach diaphragm. For example, the obturator 120 may act to contain the combustible gasses within the chamber 114 of the boost mechanism 110. In some implementations, the QRF 1702 may restrain the projectile 118 prior to filing, such as when no obturator 120 is in use. The QRF 1702 may also be used to hold the endcap 1602 in place at the end of a guide tube 136.

In the implementation depicted here, the QRF 1702 utilizes a spring adjustment mechanism 1704 to adjust compression or tension provided by one or more springs 1706. In one implementation, the spring adjustment mechanism 1704 may comprise set screws, a rotary motor, a linear actuator, and so forth. By changing compression or tension on the one or more springs 1706 with the spring adjustment mechanism 1704, the amount of force applied by the one or more springs 1706 to a retaining assembly 1708 may be varied. Changes in the force applied to the retaining assembly 1708 may be used to change the amount of force needed to separate the QRF 1702, to engage or disengage elements of the QRF 1702, and so forth.

The QRF 1702 may be utilized on a section 1710, such as a portion of the ram accelerator 102, the guide tube 136, and so forth. The QRF 1702 is discussed in more detail next with regard to FIG. 18. For example, the force applied by the one or more springs 1706 may be adjusted such that the obturator 120 is retained prior to ignition, but that upon ignition the increase in pressure behind the obturator 120 results in disengagement of the obturator 120 from the QRF 1702, allowing the obturator 120 and the projectile 118 to proceed down the sections of the ram accelerator 102.

Figure 18:
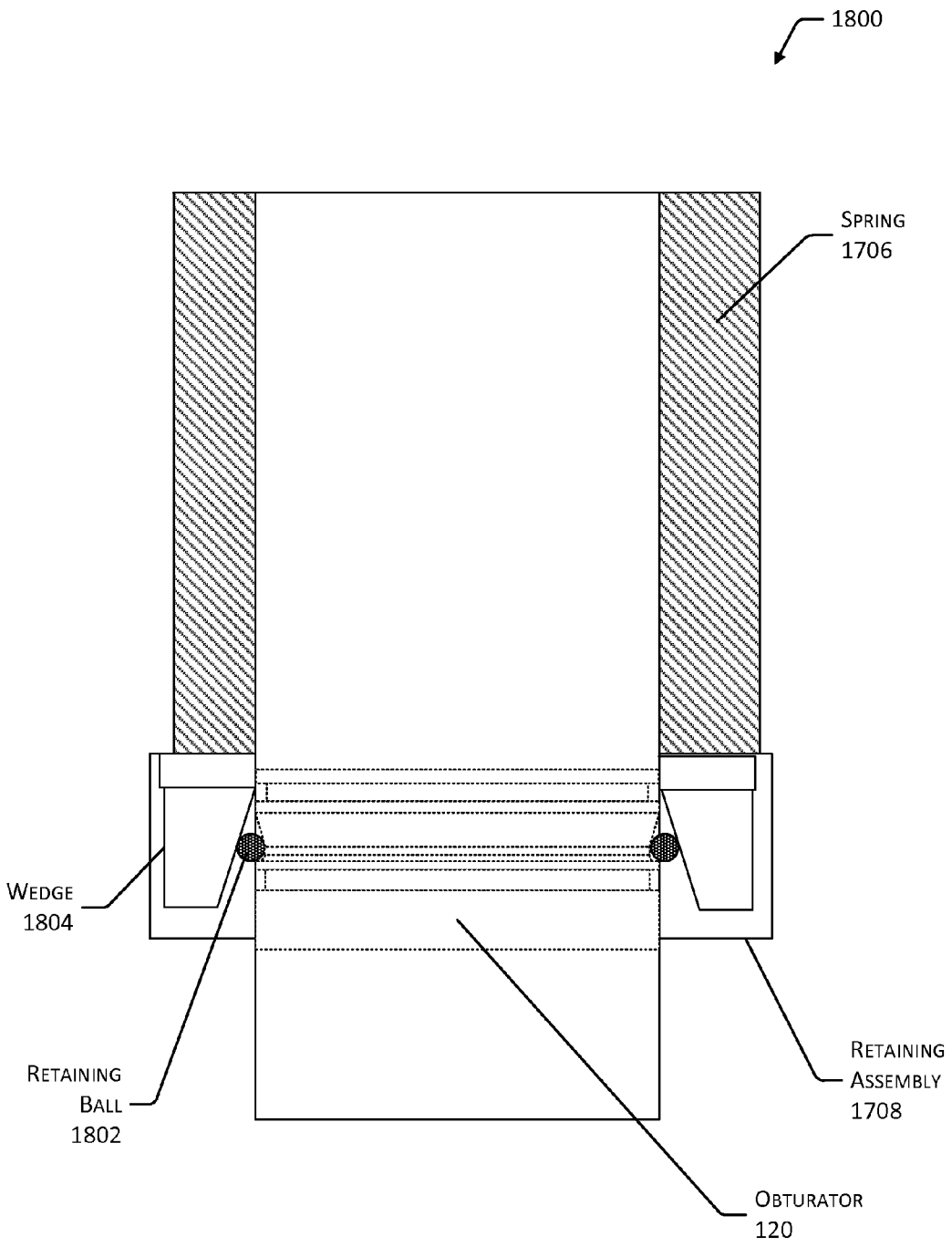
FIG. 18 illustrates a cut-away view of the quick-release fitting of FIG. 17.

FIG. 18 illustrates a cut-away view 1800 of the quick-release fitting 1702 of FIG. 17. Within the QRF 1702 may be one or more retention features, such as the retaining balls 1802 depicted here.

The retaining balls 1802 may engage a corresponding feature such as a recess, lip, or edge of the obturator 120 to maintain the placement of the obturator 120 within the QRF 1702. The one or more springs 1706 impart force to the retaining assembly 1708, which includes a wedge 1804 that is in contact with the retaining ball 1802. Force from the wedge 1804 is then transferred, at least in part, to the retaining ball 1802. By using the spring adjustment mechanism 1704, the degree of force needed to mechanically engage and disengage the obturator 120 with respect to the QRF 1702 may be adjusted.

The one or more retention features are mechanically biased inward with respect to the structure in which they are mounted. While the biasing is provided by way of springs 1706, in other implementations other mechanisms such as linear actuators, hydraulic pressure, pneumatic pressure, and so forth may provide a biasing force.

Figure 19:
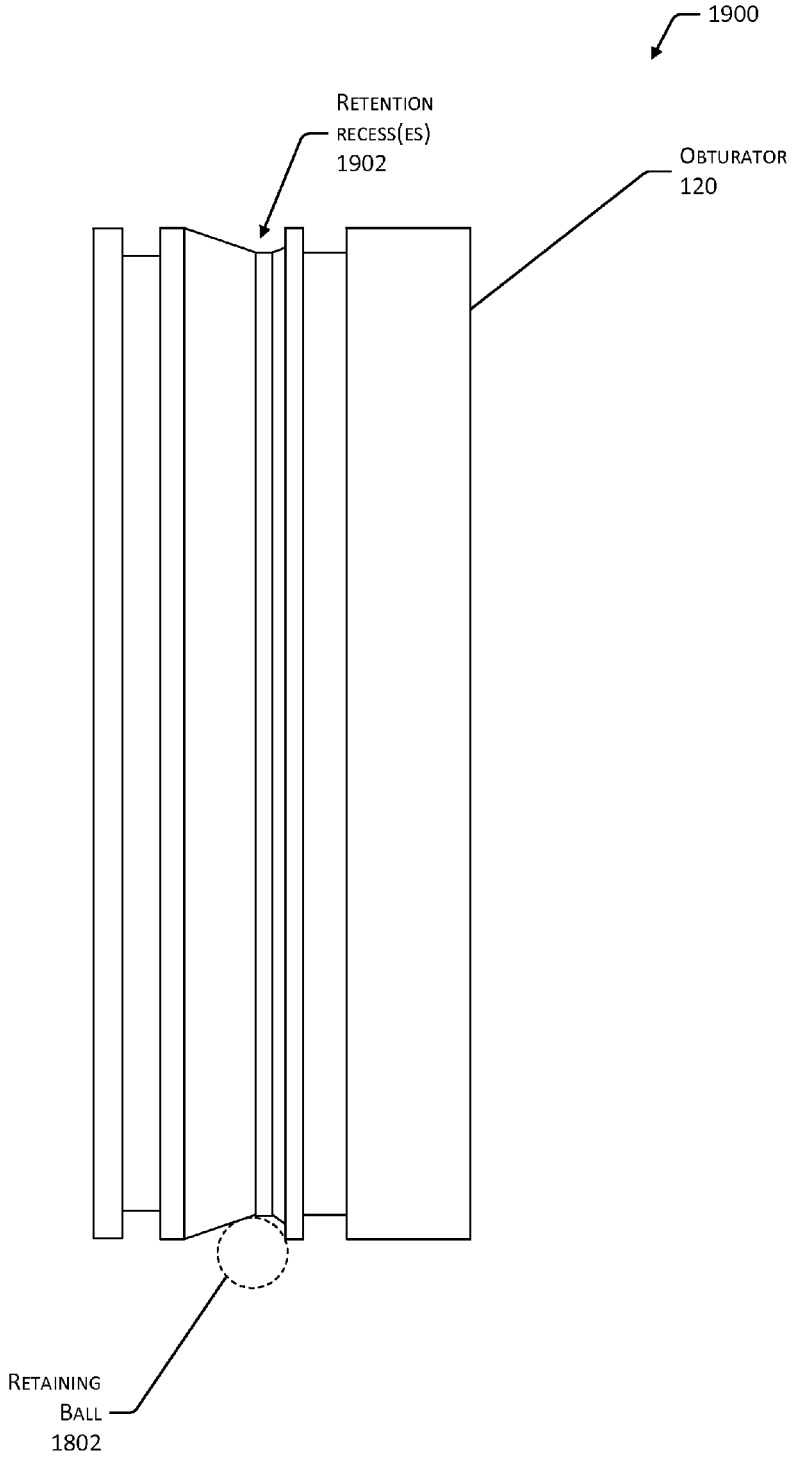
FIG. 19 illustrates a side view of an obturator having retention features for engagement by a portion of the quick-release fitting.

FIG. 19 illustrates a side view 1900 of an obturator 120 having retention recesses 1902 for engagement by a portion of the QRF 1702. For example, the retention recess 1902 indicated here may comprise a recess with a ramped or angled edge. In some implementations the obturator 120 may include gaskets, seals, and so forth. For example, o-rings may be inserted into channels on the obturator 120 to improve the seal between the obturator 120 and the inner walls of the launch tube 116.

In some implementations, the obturator 120 and the projectile 118 may be a single piece. For example, a portion of the body of the projectile 118 may include one or more engagement recess 1902 suitable for engagement to the QRF 1702. In other implementations, instead of or in addition to the engagement recess 1902, other engagement features may be present on the obturator 120. For example, one or more breakaway pins may be used to restrain the obturator 120 prior to or during at least a portion of firing.

Figure 20:
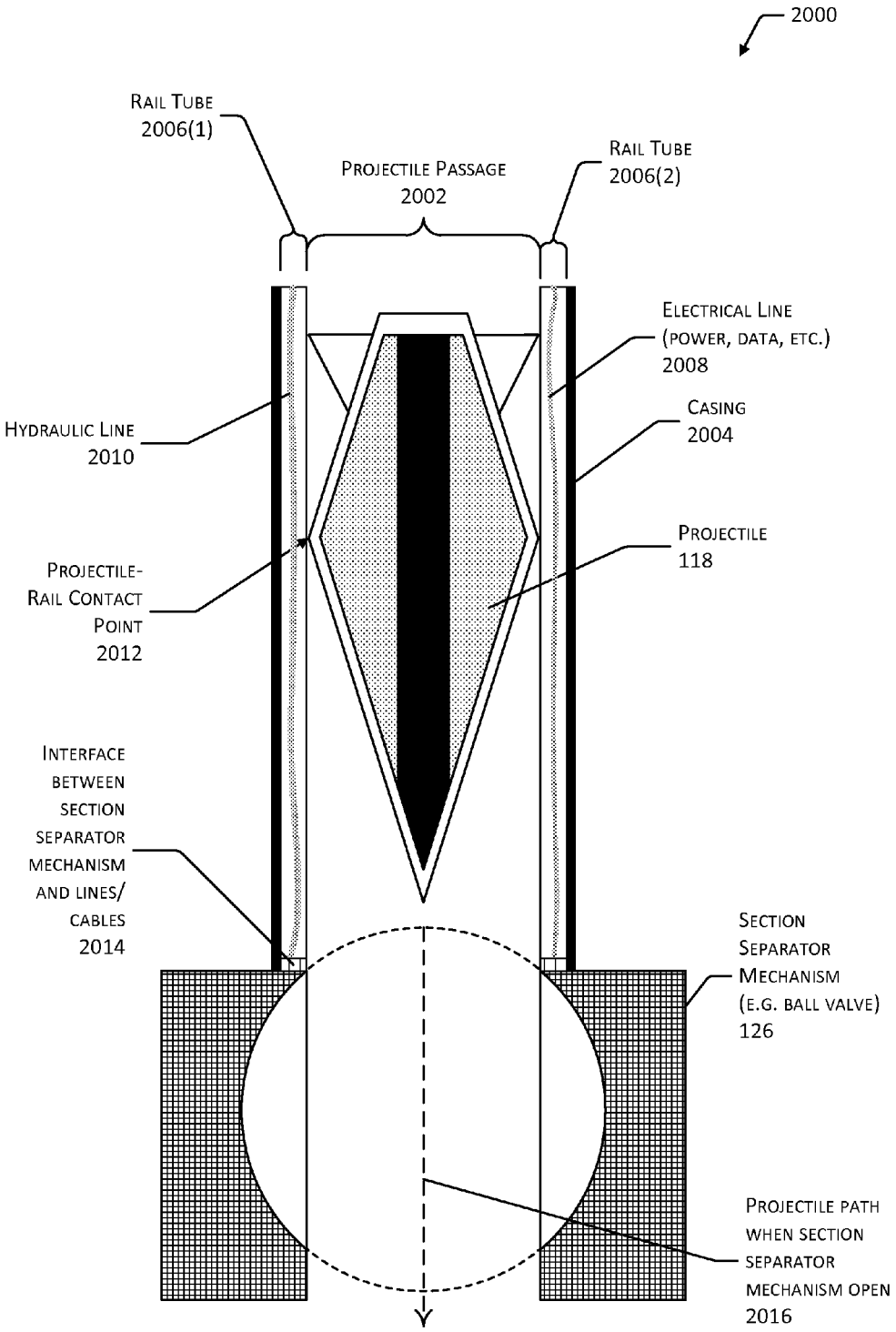
FIG. 20 illustrates a casing with rail tubes to convey utilities, direct the projectile, and so forth.

FIG. 20 illustrates a side view 2000 of an implementation of one or more of the ram accelerator sections 124, the guide tubes 136, and so forth. For example, the section may comprise a tubular casing or pipe.

A projectile passage 2002 is provided by an interior surface of the casing 2004 and one or more rail tubes 2006. In some implementations, the casing 2004 may have a circular cross section. The rail tubes 2006 may provide one or more functions including, but not limited to, increasing the rigidity of section, transporting utilities, directing the projectile 118 during transit through the section, and so forth.

The rail tube 2006 may act as conduits or passageways for one or more of an electrical line 2008, optical line, a pneumatic line, a hydraulic line 2010, and so forth. For example, the electrical line 2008 may provide electrical power to operate the section separator mechanism 126, instrumentation, and so forth. In another example, the electrical line 2008 or the optical line such as optical fiber may be used to transmit data, control the section separator mechanism 126, gather information, and so forth.

In other implementations, the rail tube 2006 may be used as a conduit or pathway. For example, the rail tube 2006 may be used to convey ejecta 606 from downhole to the surface, to distribute gasses or liquids to the sections or other points in the system 100, and so forth. In one implementation, the rail tube 2006 may be used to deliver combustible gasses into at least a portion of the section.

The rail tubes 2006 are depicted as tubes having a circular cross section. However, in other implementations, other rail members may be used, having other cross sections. For example, the rail members may have an "M" cross section, and "H" cross section, and so forth. The rail tube 2006 may include engagement features to engage at least a portion of the projectile 118. For example, the side of the projectile 118 is touching an inner portion of the rail tubes 2006 at the projectile-rail contact point(s) 2012. In another implementation, the projectile 118 may have an engagement feature such as a slot that engages a member extending from one or more of the rail tubes 2006. The rail tubes 2006 may be the same or different from other rail tubes 2006 in the section. The cross section of the rail tubes 2006 may be the same or different from other rail tubes 2006 in the section.

As described above, in some implementations, the projectile 118 may include features such as fins 416 or other engagement features. The rail tubes 2006 may have corresponding features to engage these engagement features of the projectile 118. For example, the "H" cross section may be configured to engage the fin 416 on the projectile 118 between the "arms" of the H. As described above, the rail tubes 2006 may also have features to remove or reshape the fins 416 or other portions of the projectile 118. For example, the rail tubes 2006 may contain cutting edges to assist in shearing off at least a portion of the fins 416 of the projectile 118 prior to entry to the section separator mechanism 126.

Also depicted is an interface 2014 between the section separator mechanism and the lines, cables, or other utilities conveyed by the rail tubes 206. For example, the interface 2014 may include components that convert changes in pressure to a fluid within the rail tube 2006 into a particular action, such as opening or closing a ball valve in the section separator mechanism 126.

The rail tubes 2006 may also be configured to direct the projectile 118 through and from the section separator mechanism 126. For example, the rail tubes 2006 may center the projectile 118 for entry into the ball valve and acquire the projectile 118 on exit for further guidance.

Shown with a dotted line within the section separator mechanism 126 is the projectile path 2016 through the section separator mechanism 126. For example, the path may lead through a ball valve in an "open" state. In the "open" state, the projectile 118 may pass freely from one section to another.

Figure 21:
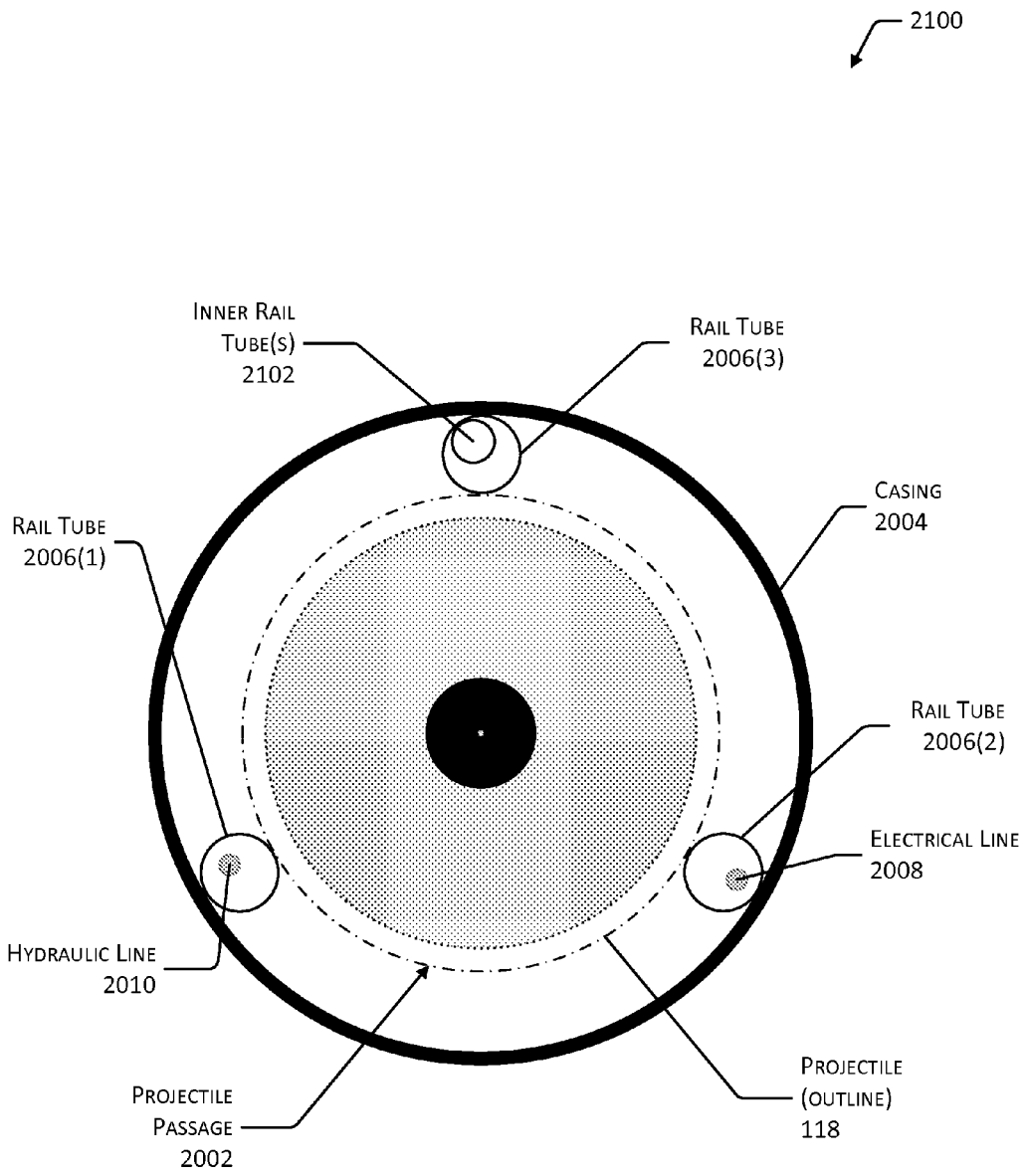
FIG. 21 illustrates additional views of the casing of FIG. 20, depicting the rail tubes and a projectile passage.

FIG. 21 illustrates a cross sectional view 2100 of the casing of FIG. 20. The cross sectional view 2100 depicts three rail tubes 2006(1), 2006(2), 2006(3) inside the casing 2004, spaced equidistantly around a circumference of the casing 2004. In other implementations, more or fewer rail tubes 2006 may be used. In this illustration, the rail tubes 2006 are depicted as having circular cross sections. However, as described above, the rail members may have different cross sectional shapes, such as "H", "C", "V", "T", and so forth.

The rail tubes 2006 within the casing 2004 provide a projectile passage 2002. During operation of the system 100, the projectile 118 is guided or directed along the projectile passage 2002 by the rail tubes 2006. For example, the guidance may be provided in the form of physical contact, such as where the projectile 118 touches the rail tube 2006. A rail tube 2006 may thus be between the projectile 118 and a portion of the casing 2004. In another example, the guidance may be provided by the interaction of shockwaves projected by the motion of the projectile 118 interacting with one or more of the outer surfaces of the rail tubes 2006, the inner surface of the casing 2004, and so forth.

The rail tubes 2006 may also be used to direct deployment of the endcap 1602. For example, the endcap 1602 may have engagement features to couple to the rail tubes 2006 to allow for placement of the endcap 1602 at the end of the guide tube 136 that is proximate to the working face.

In some implementations, inner rail tubes 2102 may be within a particular rail tube 2006. For example, the inner rail tube 2102 may be used to transport fluids such as a liquid or gas, drilling mud, and so forth.

A single rail tube 2006 may include several inner rail tubes 2102 or other utilities. For example, a first rail tube 2006 may include an inner rail tube 2102 for fiber optics, another for hydraulic fluid, and so forth.

In some implementations, the rail tubes 2006 may be used to deploy the endcaps 1602. For example, the endcaps 1602 may comprise a foam that is delivered to the working face by way of one or more rail tubes 2006. The foam may harden and provide a desired seal.

By utilizing the techniques described above, the system 100 may be used in a "single side operation" mode, such that loading and operation of the system 100 occurs at or near ground level. For example, the rail tubes 2006 provide conduits for various utilities such as control, material transport, and so forth, between surface support facilities and the downhole environment.

Figure 22:
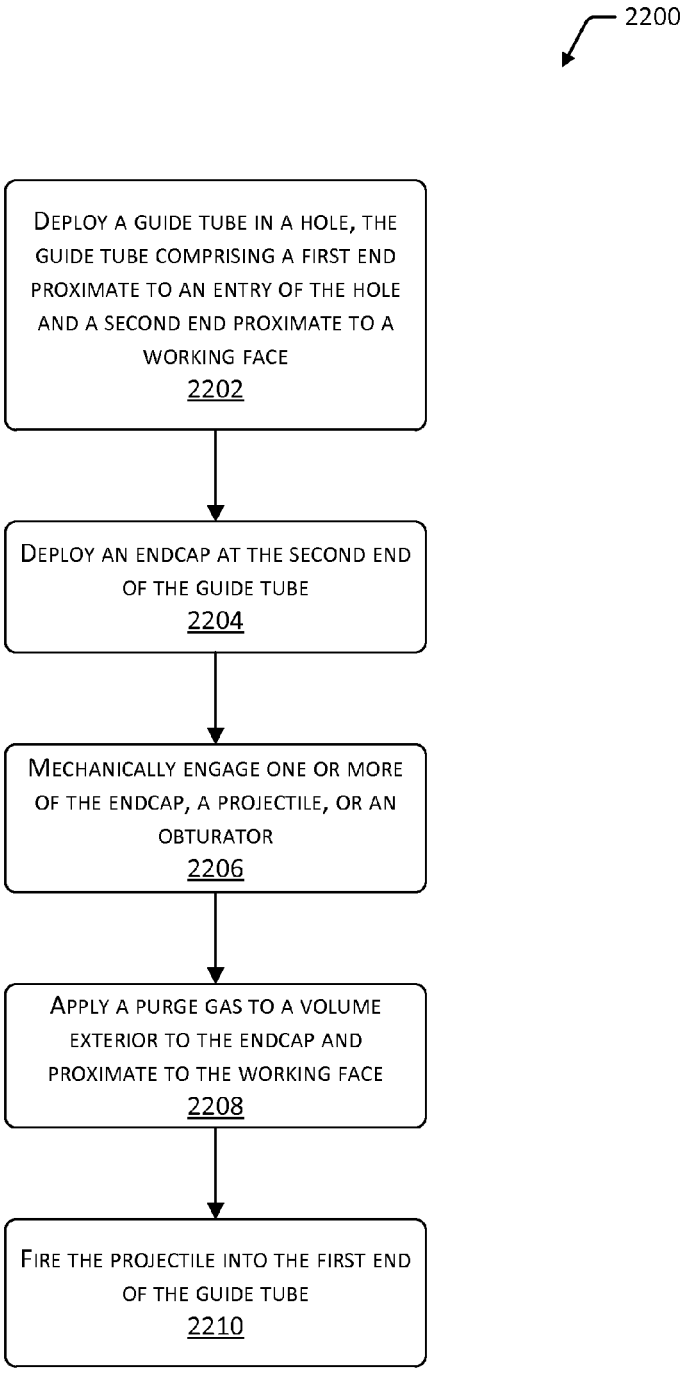
FIG. 22 is a flow diagram of a process of drilling a hole using a ram accelerator and endcaps.

FIG. 22 is a flow diagram 2200 of a process of drilling a hole 134 using the ram accelerator 102 and endcaps 1602.

At block 2202, a guide tube 136 is deployed in a hole 134. The guide tube 136 may comprise a first end proximate to an entry of the hole 134 and a second end proximate to a working face within the hole 134.

At block 2204, an endcap 1602 is deployed at the second end of the guide tube 136. For example, the endcap 1602 may be drawn to the working face under the influence of gravity, pressure differential, and so forth.

At block 2206, one or more of the endcap 1602, the projectile 118, the obturator 120, or another object may be engaged using the QRF 1702. For example, the obturator 120 may be mechanically restrained prior to firing in the launch tube 116 using the QRF 1702. In another example, the endcap 1602 may be held in place at the second end of the guide tube 136 proximate to the working face with another QRF 1702.

At block 2208, a purge gas may be applied to a volume exterior to the endcap 1602 and proximate to the working face. This may create a ullage 1612 in the formation fluid 1604.

At block 2210, a ram-effect propelled projectile 118 is fired from a ram accelerator 102 into the first end of the guide tube 136. The projectile 118 may penetrate the endcap 1602 in some implementations. In other implementations, the endcap 1602 may disintegrate or otherwise be destroyed prior to penetration by the projectile 118. For example, a shockwave preceding the projectile 118 may destroy the endcap 1602 prior to penetration.

Clauses

The following sets of clauses provide additional description.

First Set of Clauses

1. A method for drilling, the method comprising:
   deploying a guide tube in a hole, the guide tube comprising a first end proximate to an entry of the hole and a second end proximate to a working face;
   deploying an endcap at the second end of the guide tube; and
   firing, using a ram accelerator, a ram-effect propelled projectile into the first end of the guide tube.
2. The method of clause 1, further comprising:
   mechanically engaging one or more of the projectile, the endcap, or an obturator at a particular location within one or more of the ram accelerator or the guide tube.
3. The method as in one or more of clauses 1-2, further comprising:
   applying a purge gas to a volume exterior to the endcap and proximate to the working face.
4. The method as in one or more of clauses 1-3, wherein the purge gas forms a ullage in contents of the hole prior to penetration of the projectile.

5. The method as in one or more of clauses 1-4, wherein the projectile substantially penetrates the endcap and at least a portion of the projectile impacts at least a portion of the working face.

6. The method as in one or more of clauses 1-5, wherein a shape of the endcap comprises a concavity configured to accept the projectile.

7. The method as in one or more of clauses 1-6, wherein the endcap forms at least a partial seal between an interior of the guide tube and fluid in the hole.

8. The method as in one or more of clauses 1-7, wherein the endcap comprises a material configured to expand or swell, and further wherein the endcap provides a seal between the first end and the second end of the guide tube.

9. The method as in one or more of clauses 1-8, wherein the endcap comprises a structure configured to change from a first physical configuration to a second physical configuration, wherein the second physical configuration exhibits a greater width than the first physical configuration, and further wherein the endcap provides a seal between the first end and the second end of the guide tube.

10. The method as in one or more of clauses 1-9, the deploying the endcap comprising one or more of:

drawing the endcap by gravity to the second end of the guide tube, applying a positive fluid pressure at the first end of the guide tube to draw the endcap to the second end of the guide tube, applying a negative fluid pressure outside of the second end of the guide tube to draw the endcap to the second end of the guide tube, or pushing the endcap to the second end of the guide tube with a mechanical member.

11. A method comprising:

deploying an endcap at a distal end of a guide tube, wherein the endcap is guided by a rail tube within the guide tube; and firing, using a ram accelerator, a propelled projectile into a proximal end of the guide tube, wherein the projectile is guided by the rail tube within the guide tube.

12. The method of clause 11, further comprising:

forming a ullage within a fluid proximate to the distal end of the guide tube.

13. An apparatus comprising:

a first section; and a first rail member disposed within the first section, wherein the first rail member is configured to guide one or more of a projectile or an endcap during passage through the first section.

14. The apparatus of clause 13, wherein the first rail member comprises one or more engagement features to engage at least a portion of the one or more of the projectile or the endcap.

15. The apparatus as in one or more of clauses 13-14, further comprising:

a section separator mechanism coupled to an end of the first section;

wherein the first rail member provides one or more utilities to operate the section separator mechanism.

16. The apparatus as in one or more of clauses 13-15, wherein the first rail member conveys combustible gasses into at least a portion of the first section.

17. The apparatus as in one or more of clauses 13-16, further comprising a second rail member and a third rail member, wherein the first rail member, the second rail member, and the third rail member are arranged equidistant along a circumference of the first section.

18. The apparatus as in one or more of clauses 13-17, further comprising a second section, wherein the second section comprises one or more retention features biased inward with respect to the second section by one or more springs.

19. The apparatus as in one or more of clauses 13-18, further comprising one or more of an obturator, a projectile, or the endcap having one or more retention recesses configured to be engaged by the retention features.

20. The apparatus as in one or more of clauses 13-19, further comprising:

a baffled-tube ram accelerator comprising one or more baffles.

Second Set of Clauses

1. A method for drilling a hole, the method comprising:

positioning a ram accelerator relative to a working face comprising a geologic material, wherein the ram accelerator comprises a launch tube having a plurality of sections and each one of the plurality of sections is configured to hold one or more combustible gasses;

determining a set of firing parameters associated with the ram accelerator based on one or more characteristics;

deploying an endcap at an end of launch tube proximate to a working face;

applying a purge gas to a volume defined at least in part by the endcap and the working face;

configuring the ram accelerator based at least in part on the set of firing parameters;

selecting a projectile to load into the ram accelerator based at least in part on the set of firing parameters;

loading the projectile in the ram accelerator, wherein the projectile is configured to initiate a ram-effect combustion reaction in the one or more combustible gasses;

priming the plurality of sections of the launch tube of the ram accelerator with the plurality of combustible gasses;

boosting the projectile into the plurality of sections along the launch tube of the ram accelerator at a ram velocity;

accelerating the projectile by combusting the one or more combustible gasses in the plurality of sections in a ram combustion effect;

ejecting the projectile towards the working face at a velocity that exceeds two kilometers per second; and removing ejecta resulting at least in part from a hole in the working face resulting from a collision of the projectile with the geologic material at the working face.

2. The method of clause 1, wherein the projectile comprises no onboard propellant.

3. The method as in one or more of clauses 1 or 2, wherein the one or more characteristics comprise one or more of:

characteristics of the geologic material, mass of the projectile, composition of one or more portions of the projectile, or ambient environmental conditions.

4. The method as in one or more of clauses 1-3, the boosting the projectile comprising imposing a physical impulse onto the projectile by one or more of:

one or more combustible gasses in a gas gun, an electromagnetic launcher, a solid explosive charge, or a liquid explosive charge.

5. The method as in one or more of clauses 1-4, further comprising reaming the hole to provide a substantially uniform cross section of the hole.

6. The method as in one or more of clauses 1-5, wherein the hole is created along a curved drilling path.

7. The method as in one or more of clauses 1-6, after ejecting the projectile, further comprising positioning a second ram accelerator in place of the ram accelerator.

8. The method as in one or more of clauses 1-7, further comprising coupling at least one guide tube to the ram accelerator, wherein the guide tube is configured to be inserted into the hole.

9. A system comprising:

a control system configured to determine one or more firing parameters;

one or more ram accelerators configured based at least in part on the one or more firing parameters, each of the one or more ram accelerators comprising:

a plurality of sensors configured to communicate with the control system;

a plurality of sections separated by section separator mechanisms, wherein each of the sections is configured to contain one or more combustible gasses; and a boost mechanism configured impart an impulse on a projectile such that the projectile is accelerated to a ram-effect velocity within the plurality of sections.

10. The system of clause 9, further comprising a guide tube configured to be inserted into a hole formed by impact of the projectile.

11. The system as in one or more of clauses 9-10, further comprising a concrete delivery jacket coupled to the guide tube and configured to inject a liquid concrete mixture into a space between the concrete delivery jacket and walls of a hole formed by impact of the projectile.

12. The system as in one or more of clauses 9-11, further comprising a reamer affixed to at least a portion of the guide tube, the reamer configured to provide a substantially uniform cross section of the hole.

13. The system as in one or more of clauses 9-12, wherein the projectile comprises an outer core covering at least a portion of an inner core, further wherein the inner core comprises one or more materials configured to provide an abrasive action upon impact.

14. The system as in one or more of clauses 9-13, the gas separation mechanism comprising:

a diaphragm dispenser configured to move a diaphragm material through a gap between the sections of the ram accelerator configured to contain the one or more combustible gasses.

15. The system as in one or more of clauses 9-14, further comprising a breaker device, the breaker device comprising:

one or more breaker arms configured to be inserted into a plurality of holes created by impacts of one or more projectiles ejected from a plurality of ram accelerators, the one or more breaker arms further configured to apply pressure to one or more portions of target material bounded by the plurality of holes such that the one or more portions break free of a main body of target material.

16. The system as in one or more of clauses 9-15, the control system further configured to fire a plurality of ram accelerators in a predetermined pattern configured to generate one or more focused shock waves within a target material.

17. A method for drilling a hole, the method comprising:

determining a first set of firing parameters associated with firing a ram-effect propelled projectile into a working face using a ram accelerator, wherein the working face comprises one or more target materials;

based at least in part on the first set of firing parameters, configuring the ram accelerator for firing;

firing a ram-effect propelled first projectile using a ram accelerator as configured with the first set of firing parameters towards the working face;

determining impact results of the first projectile with the working face at an impact point;

based at least in part on the impact results, determine a second set of firing parameters; and firing a ram-effect propelled second projectile using the ram accelerator as configured with the second set of firing parameters towards a point proximate to the impact point at the working face.

18. The method of clause 17, further comprising inserting a guide tube at least partially into a hole at the impact point.

19. The method as in one or more of clauses 17-18, using one or more fluids to flush ejecta from the impact point.

20. The method as in one or more of clauses 17-19, wherein the target material comprising one or more of the following:

a geologic material, a metal, a ceramic, or a solid crystal.

Third Set of Clauses

1. A method for drilling a hole, the method comprising:

deploying a tube comprising a first end proximate to an entry of the hole and a second end proximate to a working face;

deploying an endcap at the second end of the tube;

applying a purge gas to a volume exterior to the endcap and proximate to the working face; and firing, using a ram accelerator, a ram-effect propelled projectile into the first end of the tube.

2. The method of clause 1, wherein the purge gas forms a ullage in the contents of the hole prior to penetration of the projectile.

3. The method as in one or more of clauses 1 or 2, wherein the purge gas forms a gas bubble in contact with at least a portion of the endcap prior to penetration of the endcap by the projectile.

4. The method as in one or more of clauses 1-3, wherein the endcap is destroyed upon impact of the projectile.

5. The method as in one or more of clauses 1-4, wherein the endcap is penetrated by the projectile.

6. The method as in one or more of clauses 1-5, wherein the projectile substantially penetrates the endcap and at least a portion of the projectile impacts at least a portion of the working face.

7. The method of as in one or more of clauses 1-6, wherein the endcap comprises one or more of:

a plastic, a polymer, a ceramic, an elastomer, a metal, or a composite material.

In some implementations, the endcap may also comprise a combustible material.

8. The method as in one or more of clauses 1-7, wherein a shape of the endcap comprises one or more of:

a cylinder, a sphere, or a lens.

9. The method as in one or more of clauses 1-8, wherein a shape of the endcap comprises a concavity configured to accept the projectile.

10. The method as in one or more of clauses 1-9, wherein the endcap forms at least a partial seal between the interior of the tube and fluid in the hole.

11. The method as in one or more of clauses 1-10, wherein the endcap comprises a material configured to expand or swell, and further wherein the endcap provides a seal between the first end and the second end of the tube. For example, the endcap may comprise a water-permeable covering filled with a hydrophilic material such as silicone gel. Other materials such as calcium hydroxide, vitreous silica, diiron trioxide, aluminum oxide, and so forth, may also be used. Upon exposure to water within the formation fluid 1604, the endcap 1602 may swell, sealing the guide tube 136.

12. The method as in one or more of clauses 1-11, wherein the endcap comprises a structure configured to change from a first physical configuration to a second physical configuration, wherein the second physical configuration exhibits a greater width than the first physical configuration, and further wherein the endcap provides a seal between the first end and the second end of the tube. For example, the endcap may comprise a number of mechanical members which may be displaced such that they provide a radial pressure, increasing a diameter of the endcap, such that the seal is formed.

13. The method as in one or more of clauses 1-12, the deploying the endcap comprising one or more of:

drawing the endcap by gravity to the second end of the tube, applying a positive fluid pressure at the first end of the tube to draw the endcap to the second end of the tube, applying a negative fluid pressure outside of the second end of the tube to draw the endcap to the second end of the tube, or pushing the endcap to the second end of the tube with a mechanical member.

In one implementation, a sequence of ball valves or other section separator mechanisms 126 may be actuated to permit the endcap 1602 to progress to the portion of the tube which is proximate to the working face.

14. A method for drilling a hole, the method comprising:

deploying a tube in a hole, the tube comprising a first end proximate to an entry of the hole and a second end proximate to a working face;

deploying an endcap at the second end of the tube; and firing, using a ram accelerator, a ram-effect propelled projectile into the first end of the tube and through the endcap to the working face.

15. The method of clause 14, wherein the ram accelerator comprises a baffle-tube ram accelerator.

16. The method as in one or more of clauses 14 or 15, further comprising:

applying a purge gas to a volume exterior to the endcap and proximate to the working face to form a cavity within a formation fluid.

ADDITIONAL APPLICATIONS

The ram accelerator 102 may be used in industrial applications as well, such as in material production, fabrication, and so forth. In these applications, a target may comprise materials such as metal, plastic, wood, ceramic, and so forth. For example, during shipbuilding, large plates of high strength steel may need to have holes created for piping, propeller shafts, hatches, and so forth. The ram accelerator 102 may be configured to fire one or more of the projectiles 118 through one or more pieces of metal, to form the holes. Large openings may be formed by a plurality of smaller holes around a periphery of the desired opening. Conventional cutting methods such as plasma torches, saws, and so forth, may then be used to remove remaining material and finalize the opening for use. In addition to openings, the impact of the projectiles 118 may also be used to form other features such as recesses within the target. The use of the ram accelerator 102 in these industrial applications may thus enable fabrication with materials that are difficult to cut, grind, or otherwise machine.

The impact of hypervelocity projectiles 118 may also be used to create new materials, such as industrial diamonds or new alloys. Fusion of atomic nuclei may also be accomplished using the momentum provided by the projectiles 118.

Furthermore, the projectile 118 may be configured such that during the impact, particular materials are deposited within the impact region. For example, the projectile 118 may comprise carbon such that, upon impact with the target, a diamond coating from the pressures of the impact are formed on the resulting surfaces of the opening. A backstop or other mechanism may be provided to catch the ejecta 606, portions of the projectile 118 post-impact, and so forth. For example, the ram accelerator 102 may be configured to fire through the target material and towards a pool of water.

The techniques described in this application may be used to drill holes 134 in geologic material 106 or other materials in terrestrial or non-terrestrial settings. For example, the system 100 as described may be used to drill holes 134 here on Earth, on the Earth's Moon, Mars, on asteroids, and so forth.

The ram accelerator 102 may also be utilized to launch projectiles 118 into an above-ground trajectory. For example, the projectiles 118 may include payload to be delivered into orbit.

Those having ordinary skill in the art will readily recognize that certain steps or operations illustrated in the figures above can be eliminated, combined, subdivided, executed in parallel, or taken in an alternate order. Moreover, the methods described above may be implemented as one or more software programs for a computer system and are encoded in a computer-readable storage medium as instructions executable on one or more processors. Separate instances of these programs can be executed on or distributed across separate computer systems.

Although certain steps have been described as being performed by certain devices, processes, or entities, this need not be the case, and a variety of alternative implementations will be understood by those having ordinary skill in the art.

Additionally, those having ordinary skill in the art will readily recognize that the techniques described above can be utilized in a variety of devices, environments, and situations. Although the present disclosure is written with respect to specific embodiments and implementations, various changes and modifications may be suggested to one skilled in the art, and it is intended that the present disclosure encompass such changes and modifications that fall within the scope of the appended claims.

What is claimed is:

1. A method for drilling, the method comprising:

deploying a guide tube in a hole, the guide tube comprising a first end proximate to an entry of the hole and a second end proximate to a working face;

deploying an endcap at the second end of the guide tube, wherein the endcap is guided by a rail tube within the guide tube; and firing, using a ram accelerator, a ram-effect propelled projectile into the first end of the guide tube.

2. The method of claim 1, further comprising:

mechanically engaging one or more of the projectile, the endcap, or an obturator at a particular location within one or more of the ram accelerator or the guide tube.

3. The method of claim 1, further comprising:

applying a purge gas to a volume exterior to the endcap and proximate to the working face.

4. The method of claim 3, wherein the purge gas forms an ullage in contents of the hole prior to penetration of the projectile.

5. The method of claim 1, wherein the projectile substantially penetrates the endcap and at least a portion of the projectile impacts at least a portion of the working face.

6. The method of claim 1, wherein a shape of the endcap comprises a concavity configured to accept the projectile.

7. The method of claim 1, wherein the endcap forms at least a partial seal between an interior of the guide tube and fluid in the hole.

8. The method of claim 1, wherein the endcap comprises a material configured to expand or swell, and further wherein the endcap provides a seal between the first end and the second end of the guide tube.

9. The method of claim 1, wherein the endcap comprises a structure configured to change from a first physical configuration to a second physical configuration, wherein the second physical configuration exhibits a greater width than the first physical configuration, and further wherein the endcap provides a seal between the first end and the second end of the guide tube.

10. The method of claim 1, wherein the deploying of the endcap further comprises one or more of:

drawing the endcap by gravity to the second end of the guide tube, applying a positive fluid pressure at the first end of the guide tube to draw the endcap to the second end of the guide tube, applying a negative fluid pressure outside of the second end of the guide tube to draw the endcap to the second end of the guide tube, or pushing the endcap to the second end of the guide tube with a mechanical member.

11. A method comprising:

deploying an endcap at a distal end of a guide tube, wherein the endcap is guided by a rail tube within the guide tube; and firing, using a ram accelerator, a propelled projectile into a proximal end of the guide tube, wherein the projectile is guided by the rail tube within the guide tube.

12. The method of claim 11, further comprising:

forming an ullage within a fluid proximate to the distal end of the guide tube.

13. An apparatus comprising:

a first section; and a first rail member disposed within the first section, wherein the first rail member is configured to guide at least a projectile and an endcap during passage through the first section.

14. The apparatus of claim 13, wherein the first rail member comprises one or more engagement features to engage at least a portion of the projectile or the endcap.

15. The apparatus of claim 13, further comprising:

a section separator mechanism coupled to an end of the first section; and wherein the first rail member provides one or more utilities to operate the section separator mechanism.

16. The apparatus of claim 13, wherein the first rail member conveys combustible gasses into at least a portion of the first section.

17. The apparatus of claim 13, further comprising a second rail member and a third rail member, wherein the first rail member, the second rail member, and the third rail member are arranged equidistant along a circumference of the first section.

18. The apparatus of claim 13, further comprising a second section, wherein the second section comprises one or more retention features biased inward with respect to the second section by one or more springs.

19. The apparatus of claim 18, further comprising an obturator, wherein the obturator, the projectile, or the endcap have one or more retention recesses configured to be engaged by the retention features.

20. The apparatus of claim 13, further comprising:

a baffled-tube ram accelerator comprising one or more baffles.

* * * * *